US006920085B2

(12) United States Patent
Finke et al.

(10) Patent No.: US 6,920,085 B2
(45) Date of Patent: Jul. 19, 2005

(54) DOWNLINK TELEMETRY SYSTEM

(75) Inventors: Michael Dewayne Finke, Houston, TX (US); Doyle Raymond Warren, II, Spring, TX (US); Cili Sun, Sugar Land, TX (US); Bipin Kumar Pillai, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 660 days.

(21) Appl. No.: 09/783,158

(22) Filed: Feb. 14, 2001

(65) Prior Publication Data

US 2003/0016164 A1 Jan. 23, 2003

(51) Int. Cl.[7] ..... H04H 9/00

(52) U.S. Cl. ..... 367/83; 340/853.1; 340/854.3; 175/61; 166/373

(58) Field of Search ..... 367/81, 83; 340/853.1, 340/854.3; 166/375, 373; 175/61, 220

(56) References Cited

U.S. PATENT DOCUMENTS

| | | | | |
|---|---|---|---|---|
| 4,078,620 A | | 3/1978 | Westlake et al. | 175/18 |
| 4,461,359 A | | 7/1984 | Jones, Jr. et al. | 175/61 |
| 4,471,843 A | | 9/1984 | Jones, Jr. et al. | 175/73 |
| 4,550,392 A | * | 10/1985 | Mumby | 367/82 |
| 4,556,884 A | * | 12/1985 | Howells et al. | 340/855.3 |
| 4,689,775 A | | 8/1987 | Scherbatskoy | 367/83 |
| 4,794,534 A | * | 12/1988 | Millheim | 702/9 |
| 5,113,379 A | | 5/1992 | Scherbatskoy | 367/83 |
| 5,115,415 A | | 5/1992 | Mumby et al. | 367/85 |
| 5,148,408 A | | 9/1992 | Matthews | 367/82 |
| 5,150,333 A | | 9/1992 | Scherbatskoy | 367/83 |
| 5,318,137 A | | 6/1994 | Johnson et al. | 175/40 |
| 5,318,138 A | | 6/1994 | Dewey et al. | 175/74 |

(Continued)

FOREIGN PATENT DOCUMENTS

| | | | |
|---|---|---|---|
| EP | 0 744 527 A1 | 11/1996 | E21B/47/12 |
| EP | 0 744 527 B1 | 7/2001 | E21B/47/12 |
| WO | WO 97/14869 | 4/1997 | E21B/47/18 |
| WO | WO 99/19751 | 4/1999 | G01V/3/00 |
| WO | WO 99/54591 | 10/1999 | E21B/41/00 |
| WO | WO 99/61746 | 12/1999 | E21B/34/16 |
| WO | WO 00/28188 | 5/2000 | E21B/7/06 |

OTHER PUBLICATIONS

Odell II, A. C., et al; SPE 30462; *Application of a Highly Variable Gauge Stabilizer at Wytch Farm to Extend the ERD Envelope*; Oct. 22–25, 1995 SPE Annual Technical Conference; (pp. 119–129).

(Continued)

*Primary Examiner*—Timothy Edwards, Jr.
(74) *Attorney, Agent, or Firm*—Conley Rose, P.C.

(57) ABSTRACT

A downlink telemetry system providing improved apparatus and methods for communicating instructions via pressure pulses from surface equipment to a downhole assembly. The apparatus comprises a surface transmitter for generating pressure pulses, a control system, and a downhole receiver for receiving and decoding pulses.

In operation, a bypass valve is opened and closed to create a series of pressure pulses received and decoded by a downhole receiver. The method significantly reduces the time required for downlink communication without interrupting drilling and without interrupting uplink communications such that simultaneous, bi-directional communication is achievable if the uplink and downlink signals are sent at different frequencies.

The telemetry scheme and algorithm provide an inventive method for filtering and decoding the downlink signals. The algorithm determines the time intervals between pulse peaks and decodes the intervals into an instruction. The algorithm also includes error checking for verifying that the instruction was properly received downhole.

88 Claims, 8 Drawing Sheets

U.S. PATENT DOCUMENTS 5,331,318 A * 7/1994 Montgomery ..... 340/855.4
5,332,048 A 7/1994 Underwood et al. ..... 175/26
5,390,153 A 2/1995 Scherbatskoy ..... 367/83
5,467,083 A 11/1995 McDonald et al. ..... 340/854.6
5,579,283 A 11/1996 Owens et al. ..... 367/83
5,615,172 A 3/1997 Kotlyar ..... 367/83
5,703,836 A 12/1997 Drumheller ..... 367/165
5,722,488 A 3/1998 Normann et al. ..... 166/65.1
5,787,052 A 7/1998 Gardner et al. ..... 367/84
5,802,011 A 9/1998 Winters et al. ..... 367/83
5,803,185 A 9/1998 Barr et al. ..... 175/45
5,818,352 A 10/1998 McClure ..... 340/854.6
5,836,353 A 11/1998 Van Steenwyk ..... 137/624.15
5,959,547 A * 9/1999 Tubel et al. ..... 340/853.2
5,963,138 A 10/1999 Gruenhagen ..... 340/679
6,021,095 A 2/2000 Tubel et al. ..... 367/82
6,097,310 A 8/2000 Harrell et al. ..... 340/854.3
6,105,690 A 8/2000 Biglin, Jr. et al. ..... 175/48
6,182,764 B1 * 2/2001 Vaynshteyn ..... 166/373
6,516,898 B1 * 2/2003 Krueger ..... 175/50
6,536,529 B1 * 3/2003 Kerr et al. ..... 166/375

OTHER PUBLICATIONS

AutoTrak™ Rotary Closed Loop Drilling System; Baker Hughes Inteq: (1997) (pp. 12).

AutoTrak; [online]. Retrieved from the Internet<URL: http://www.bakerhughes.com/inteq/Drilling/autotrak/autotrak.htm (pp. 1–9).

*TRACS™:Telemetry regulated Angle Control System*; Halliburton Energy Services; Directional Drilling Services; 1995; (pp. 2).

*TRACS™Adjustable Stabilizer: Telemetry regulated Angle Control system Improve Drilling Efficiency, Maximize Drilling Control*; Halliburton Energy Services; 1995; (pp. 8).

PCT International Search Report for Appln. No. PCT/US02/04264 dated Jul. 16, 2002; (5 p.).

* cited by examiner

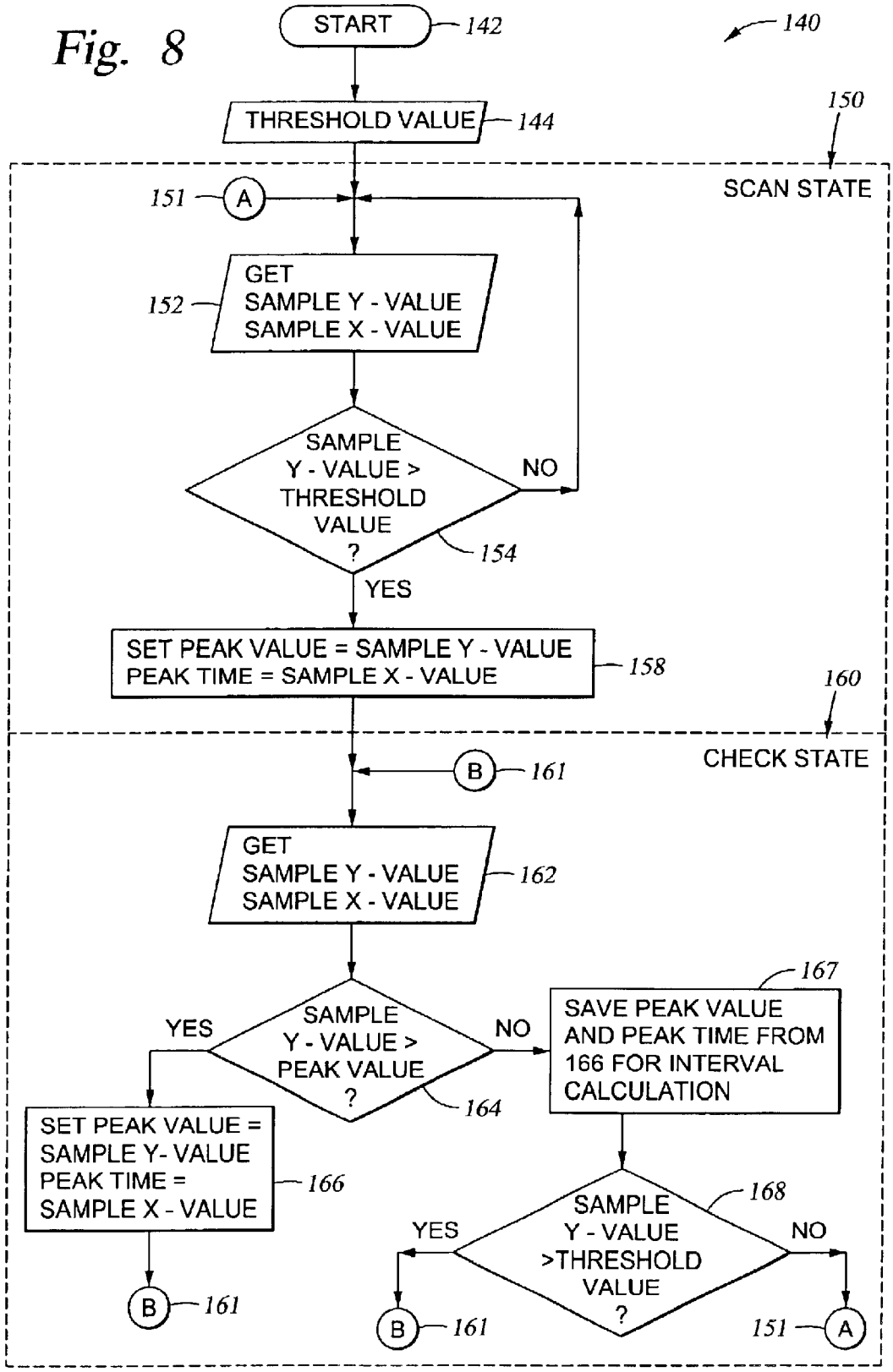
Fig. 8
START
142
140
THRESHOLD VALUE
144
150
SCAN STATE
151
A
GET
SAMPLE Y - VALUE
SAMPLE X - VALUE
152
SAMPLE
Y - VALUE >
THRESHOLD
VALUE
?
NO
154
YES
SET PEAK VALUE = SAMPLE Y - VALUE
PEAK TIME = SAMPLE X - VALUE
158
160
CHECK STATE
B
161
GET
SAMPLE Y - VALUE
SAMPLE X - VALUE
162
167
SAMPLE
Y - VALUE >
PEAK VALUE
?
YES
NO
164
SAVE PEAK VALUE
AND PEAK TIME FROM
166 FOR INTERVAL
CALCULATION
SET PEAK VALUE =
SAMPLE Y- VALUE
PEAK TIME =
SAMPLE X - VALUE
166
168
SAMPLE
Y - VALUE
>THRESHOLD
VALUE
?
YES
NO
B
161
B
161
151
A

DOWNLINK TELEMETRY SYSTEM

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates generally to communicating between control equipment on the earth's surface and a subsurface drilling assembly to command downhole instrumentation functions. In particular, the present invention relates to apparatus and methods for communicating instructions to the drilling assembly via pressure pulse signals sent from a surface transmitter without interrupting drilling, and more particularly to apparatus and methods for detecting pressure pulses at a downhole receiver and using an algorithm to decode the pressure pulses into instructions for the downhole assembly, and still more particularly to apparatus and methods for achieving bi-directional communication between the surface equipment and the downhole assembly at a relatively rapid communication rate.

BACKGROUND OF THE INVENTION

A hydrocarbon drilling operation utilizes control and data collection equipment on the earth's surface and subsurface equipment such as a drilling assembly having drilling apparatus and formation evaluation tools that measure properties of the well being drilled. It has long been recognized in the oil and gas industry that communicating between the surface equipment and the subsurface drilling assembly is both desirable and necessary.

Downlink signaling, or communicating from the surface equipment to the drilling assembly, is typically performed to provide instructions in the form of commands to the drilling assembly. For example, in a directional drilling operation, downlink signals may instruct the drilling apparatus to alter the direction of the drill bit by a particular angle or to change the direction of the tool face. Uplink signaling, or communicating between the drilling assembly and the surface equipment, is typically performed to verify the downlink instructions and to communicate data measured downhole during drilling to provide valuable information to the drilling operator.

A common method of downlink signaling is through mud pulse telemetry. When drilling a well, fluid is pumped downhole such that a downhole receiver within the drilling assembly can meter the pressure and/or flowrate of that fluid. Mud pulse telemetry is a method of sending signals by creating a series of momentary pressure changes, or pulses, in the drilling fluid, which can be detected by a receiver. For downlink signaling, the pattern of pressure pulses, including the pulse duration, amplitude, and time between pulses, is detected by the downhole receiver and then interpreted as a particular instruction to the downhole assembly.

The concept of transmitting signals from the surface of the earth to subsurface equipment through mud pulse telemetry is known and has been practiced in the past. The most common method for creating pressure pulses is by interrupting drilling and cycling the drilling pump on and off at a certain frequency to create pressure pulses that travel downhole through the drill string to instruct the downhole assembly.

Another method combines pump cycling with rotation of the drill string. Drilling is interrupted, the drilling tool is lifted off bottom, and the pumps are cycled on and off to inform the downhole assembly that an instruction will be sent from the surface. Then the drill string is rotated at a given speed over a certain duration, and the downhole assembly includes a RPM sensor to measure the rotations. In this manner, instructions are communicated to the downhole assembly.

These transmission methods have several disadvantages. The most significant disadvantage is that drilling must be temporarily interrupted every time a signal is sent downhole. Thus, signals are sent downhole only periodically rather than continuously so that forward progress can be made in the drilling operation. During directional drilling, this can be particularly undesirable because the drilling tool can only be adjusted periodically resulting in an unwanted snake-like or tortuous borehole being drilled. Further, these methods are inherently slow because it takes time to start and stop the drilling operation, and although the goal is to instruct the downhole assembly by sending one set of signals, often the signals must be repeated since the downhole receiver does not always properly receive the instruction the first time. Finally, this method also causes unnecessary wear and tear to the pump and associated equipment.

Improved apparatus have been developed for transmitting command signals from the earth's surface to equipment downhole without starting and stopping the drilling system pumps. For example, U.S. Pat. No. 5,113,379 ("the '379 Patent") to Scherbatskoy, hereby incorporated herein by reference for all purposes, describes creating negative pressure pulses by the sequential operation of a valve to bypass a quantity of the drilling fluid from the fluid being pumped downhole. The bypassed fluid is returned to the mud pit, and a surge absorber is employed to prevent backpressure in the mud return line from limiting the flow of fluid through the valve. This system has the disadvantage of not providing a means for adjusting the flowrate through the bypass line. Such flowrate adjustment is desirable for producing pulses of a particular amplitude and for ensuring that the bypass flowrate does not detract from the drilling fluid flowrate in such a way that the drilling operation is stalled.

The '379 Patent describes another method for creating pressure pulses by opening and closing a valve in communication with a reservoir having a different fluid pressure than the drilling system pump pressure. Again, this pulsing system provides no apparatus for controlling the flowrate through the pulsing system, and it has more complicated equipment requirements.

Still another method described in the '379 Patent requires a motor driven pump to be connected to the drilling system to introduce positive pressure pulses into the fluid column. Although this pulsing system allows for changes in flow rate based on the motor speed, the equipment requirements are more complicated, more expensive, and require more maintenance. Thus, it is desirable to provide a transmitter system for pulsing signals downhole that has simple, inexpensive, and easily maintainable equipment and that provides a way to adjust the flowrate of the bypass fluid.

European Patent Application EP 0 744 527 A1 ("the '527 Application") filed by Baker-Hughes Incorporated, the contents of which are hereby incorporated herein for all purposes, discloses a simple bypass system for producing negative pressure pulses comprising a pneumatically actuated valve and an orifice. The orifice limits the flowrate through the bypass line, and the flowrate can further be adjusted by restricting flow through the valve itself. Further, the speed of the valve actuation is controllable for altering the frequency of the pulse signal.

Although the bypass system disclosed in the '527 Application provides an orifice for controlling the bypass flowrate, the orifice is not changeable to adjust the flow restriction as necessary. Namely, as a well is drilled deeper, a higher drilling flowrate is required to prevent the drilling tool from stalling. A change in flow resistance through the drill string may also be caused by, for example, bit jet changes, increased drill string length, and changes in the bottom hole assembly. Such flow resistance changes through the drill string require a change in the bypass flow resistance to maintain the desired bypass flowrate. Therefore, it is desirable to provide apparatus to adjust the bypass flowrate in the field. Restricting flow through the valve to adjust the bypass flowrate is not preferable because the valve internals will be eroded, and valves are costly to replace. Thus, it is desirable to include a low cost, sacrificial bypass flow restrictor that is easily changeable in the field to adjust the bypass flowrate.

Further, the invention disclosed in the '527 Application provides no component upstream of the bypass valve to reflect the positive pulses created each time the valve closes. This arrangement would pose problems if simultaneous, bi-directional communication (downlink and uplink) is desired because the positive pulses at the valve will travel upstream into the main piping and could interfere with or cancel out uplink pulses. Thus, it is desirable to provide pulse transmitter equipment arranged in such a way that simultaneous, bi-directional communication is achievable.

Once the pressure pulses representing a certain instruction are generated on the surface and transmitted downhole, a receiver disposed in the downhole assembly must decode those signals to distribute the instruction to the proper downhole tool. The receiver will detect noise associated with the pump and drilling operations in addition to the downlink signal. Therefore, decoding the downlink signal in the downhole receiver typically comprises digital filtering steps to remove the noise and using a detection algorithm to match the pressure pulse sequence to a particular preprogrammed instruction in the downhole assembly controller.

The '379 Patent describes in detail a method for analyzing uplink pulses. The data is first filtered and cross-correlated to remove pump pressure, pump noise, and random noise. Then the shape or duration of each pulse is analyzed to determine the data value associated with that pulse. With respect to downlink signals, the command signals are limited to a narrow frequency band over a particular time interval. Therefore, the relevant quantity for the receiving system is the frequency band and time of reception for the received signal. The signal passes through a lock-in amplifier filter to separate the narrow-band frequency signal from interfering noise. Then the signal passes to an amplifier and to a pulse generator, which feeds the coil of a stepping switch, preferably electronic, to step the switch for various instrument functions.

These uplink and downlink telemetry systems employ filters and algorithms for analyzing the signals, but the uplink system is significantly more sophisticated. Uplink transmission is said to involve large amounts of data that must be analyzed quickly, whereas downlink transmission is said to involve small amounts of data that can be analyzed over a longer time frame. For example, the stated data rate for uplink signals is about 120 bits per minute whereas the stated data rate for downlink signals is up to 1 bit per minute, thus requiring less power for transmission. Further, the noise downhole is said to be lower than the noise near the surface, so the filtering feature is not as complicated downhole.

However, given the complicated functionality of modem day drilling assemblies, and especially in directional drilling applications, it is desirable to have fast data rates for both uplink and downlink communications. Further, it is desirable to provide a sophisticated downlink algorithm capable of fast and accurate signal decoding, including an internal error-checking capability. In fact, it is desirable to achieve simultaneous, bi-directional communication (uplink and downlink) to send a downlink instruction that is decoded quickly, confirmed via uplink, and executed in fast progression, such that while one downlink instruction is being executed another downlink signal can be sent—either to the same tool or to a different tool. In directional drilling applications, the benefit of a fast bi-directional telemetry rate is the drilling of a very accurately located borehole that may be optimized for minimum drag since the drill bit angle and tool face can be corrected rapidly whenever it goes off course. The downlink telemetry system of the present invention overcomes the deficiencies of the prior art.

SUMMARY OF THE INVENTION

The downlink telemetry system provides improved apparatus and methods for communicating instructions via pressure pulses from control equipment on the earth's surface to a downhole assembly.

The apparatus comprises a surface transmitter for generating pressure pulses, a control system for operating the transmitter, and a downhole receiver for receiving and decoding the downlink signals into instructions to the downhole tools.

The surface transmitter includes a flow restrictor for controlling the quantity of flow through the bypass line, a flow diverter, a flow control device, such as a pneumatically operated valve that is opened and closed to generate pressure pulses, and a backpressure device to provide backpressure to the valve. The flowrate through the bypass line is adjustable in the field by changing out the flow restrictor rather than restricting flow through the flow control device. The flow restrictor is preferably an upstream orifice that provides a surface for reflecting positive pulses generated when the valve is closed. This reflecting surface prevents the positive pulses from interfering with passing uplink pulses such that simultaneous, bi-directional communication is achievable. In an alternative embodiment, the surface transmitter may include dual bypass lines.

The control system for operating the transmitter assembly includes a computer, a downlink controller, and solenoid controlled air valves that supply air to the pneumatic actuator of the flow control device.

The downhole receiver comprises either a flow meter or a pressure sensor, and a microprocessor, programmed with a telemetry scheme and algorithm for filtering and decoding the pressure pulses received downhole.

In operation, the user inputs a command to the surface computer, which sends the command to the downlink controller. The downlink controller sends a signal to the solenoid driven air valves that supply air to an "open" chamber or a "close" chamber in the pneumatic actuator of the flow control device, or choke valve. The choke valve is opened and closed to create a series of negative pressure pulses that travel down the drill string to be received and decoded by the downhole receiver.

The telemetry scheme and algorithm of the present downlink system allows for simultaneous, bi-directional communication of uplink and downlink signals sent at different frequency bands. The raw signal received by the downhole receiver includes the downlink signal, the uplink signal, the steady-state pressure, and the noise from pumping and drilling. The raw signal is passed through a first filter, preferably a median filter, to remove the uplink signal. This median-filtered signal is passed through a band pass filter, preferably a FIR filter, to remove the noise and steady-state pressure. The FIR-filtered signal is cross-correlated with a template wave, preferably a square wave, to determine the time position for each negative pressure pulse. The algorithm then determines the time intervals between the resulting cross-correlation peaks and decodes the intervals into an instruction, which has a command component and a data component. The command component relates to which tool is being instructed and what that tool is being instructed to do. The data component provides the change associated with a command. The algorithm also includes an error-checking feature for verifying the instruction before executing it. If the downhole receiver determines that a downlink signal was improperly received, an uplink signal will be sent to indicate an error, and the downlink signal will be retransmitted.

The downlink telemetry system is useful in a broad range of applications, such as instructing any tool in the downhole assembly, including the downhole receiver itself. Such instructions to the downhole receiver can be used for reprogramming or changing its operating modes, thereby fundamentally changing the way the entire downhole assembly responds to a given instruction set.

The downlink telemetry system has the advantage of significantly reducing the time required for downlink communication without interrupting drilling and without interrupting uplink communications such that simultaneous, bi-directional communication is achievable. Further, the algorithm includes an error-checking feature that ensures accuracy in downlink communication.

Thus, the present invention comprises a combination of features and advantages which enable it to overcome various problems of prior art downlink telemetry systems. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIG. 8 depicts a flow diagram of the algorithm for determining the time position of a processed signal pulse peak.

DETAILED DESCRIPTION OF THE PREFERRED EMBODIMENT

Drilling, for the purpose of extracting hydrocarbons from the earth, requires a downhole drilling assembly, which may comprise, for example, directional drilling and formation evaluation tools. To operate these drilling tools, a communication link is required between the control and data collection equipment on the surface and the downhole assembly as it drills a well below the surface of the earth.

A common way to achieve this communication link is through a method called mud pulse telemetry. Mud pulse telemetry is used for sending signals from the surface to the downhole tools (downlink) or for sending signals from the downhole assembly to the surface (uplink). Generally downlink communication sends instructions in the form of commands to the downhole tools, and uplink communication confirms the instructions received by the downhole assembly and/or provides data to the surface.

Figure 1:
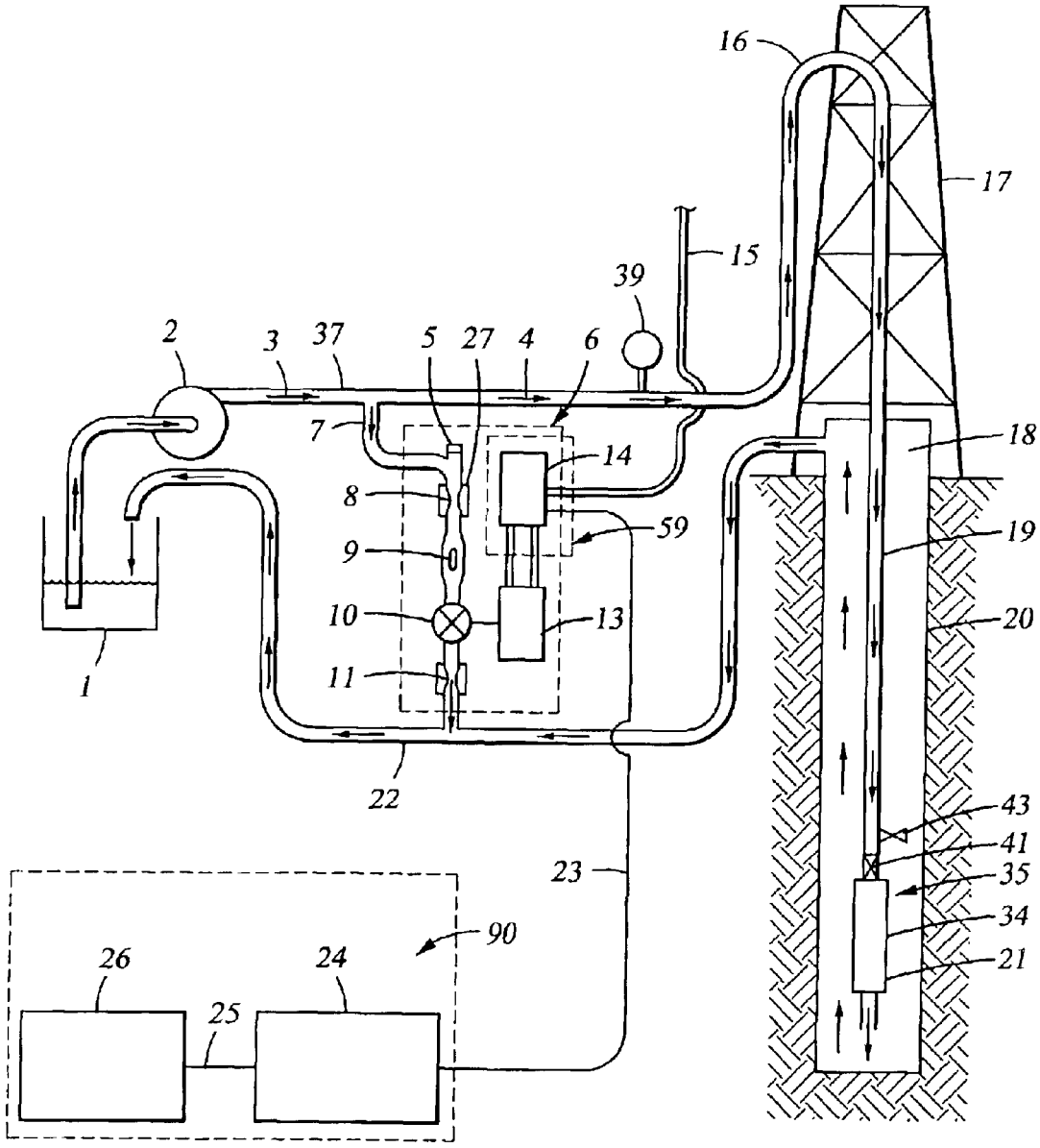
FIG. 1 is a schematic showing a typical drilling operation that may employ the downlink telemetry system of the present invention.

Referring initially to FIG. 1, there is depicted a typical drilling operation where mud pulse telemetry may be used. A well bore 20, which may be open or cased, is disposed below a drilling rig 17. A drill string 19 with a drilling assembly 35 connected to the bottom, is disposed within the well 20, forming an annular flow area 18 between the drill string 19 and the well 20. On the surface, a mud pump 2 draws drilling fluid from the fluid reservoir 1 and pumps the fluid into the pump discharge line 37, along path 3, 4. The circulating fluid flows, as shown by the arrows, into the drilling rig standpipe 16, through the drill string 19, and returns to the surface through the annulus 18. After reaching the surface, the circulating fluid is returned to the fluid reservoir 1 via the pump return line 22.

In general, to generate either uplink or downlink signals via mud pulse telemetry, a series of pressure changes, called pulses, are sent in a set pattern to either an uplink receiver 39 on the surface or a downlink receiver 21 in the downhole assembly 35. The amplitude and frequency of the pressure changes are analyzed by the receivers 39, 21 to decode the information or commands being sent. To illustrate, one uplink signal can be sent by momentarily restricting fluid downhole, at a valve 41 for example, as the fluid is pumped down the drill string 19. The momentary restriction causes a pressure increase, or a positive pulse, when the fluid impacts the point of restriction. The positive pulse flows back up the fluid in the drill string 19, and an uplink receiver 39 at the surface, typically a pressure transducer, reads the increase in pressure. An uplink signal can also be sent as a negative pulse by opening a valve 43 between the drill string 19 and the annulus 18 to allow fluid to escape, thereby creating a negative pressure wave that travels to the surface receiver 39. Using this method, the downhole assembly 35 communicates with the surface receiver 39 using either a positive pulser 41 or a negative pulser 43 that creates a series of pressure pulses that travel to the surface receiver 39.

The traditional method for downlink communication required the operator to interrupt drilling and cycle the drilling pump 2 on and off to create pressure pulses that traveled through the drill string 19 to the downhole receiver 21. The present invention comprises an apparatus and method for downlinking without interrupting drilling. The operating theory is to create pressure pulses for downlink communications by momentarily bypassing a small percentage of the total flow rather than pumping it all downhole. For that momentary bypass period, pressure and volumetric flow rate are reduced in the flow traveling downhole to create a negative pulse that is transmitted down the drill string 19. This negative pulse is detected downhole by the downhole receiver 21 as a momentary change in the fluid pressure and/or a change in the fluid velocity.

The apparatus comprises a surface transmitter assembly 6, a surface transmitter control system 90, and a downhole receiver 21. The control system 90 comprises a computer 26, and a downlink controller/barrier box 24 housing certain control equipment that is linked to a pneumatic system 59. Another feature of the present invention is a telemetry scheme and detection algorithm that are incorporated into the downhole receiver 21 and described in more detail with respect to FIG. 7 and FIG. 8.

Surface Transmitter Assembly

Referring still to FIG. 1, the surface transmitter assembly 6, which is shown in the dotted box, may be designed to operate in any pressure range depending upon the application, such as, for example, an operating pressure of approximately 10,000 psi with a maximum pressure rating of 15,000 psi. The transmitter assembly 6 can be located near the pump 2 with the bypass line 7 connected to the flow return line 22 as shown in FIG. 1, or alternatively it can be located adjacent the drilling rig standpipe 16 with the bypass line 7 connected to the annulus 18.

The surface transmitter assembly 6 consists of a flow restrictor 8, a flow diverter 9, a flow control device such as a choke valve 10 with an actuator 13, and a downstream orifice 11. The actuator 13 may be of any type, such as pneumatic, hydraulic, or electric. To send a signal or pressure pulse downhole, a portion of the total flow 3 exiting pump 2 is diverted through the bypass line 7, thereby lowering the pressure and flowrate of the fluid 4 going downhole to create a negative pulse. A negative pulse is created by operating the actuator 13 to open the choke valve 10, which opens the bypass line 7 to divert fluid through the transmitter assembly 6 away from the total flow 3 exiting the pump 2.

The amount of fluid that diverts through the bypass line 7 is controlled either by restricting flow through the choke valve 10 or by fully opening the choke valve 10 and restricting the flow through the bypass line 7 in another way. Preferably an upstream orifice 8 acts as a flow restrictor to control the quantity of flow through the bypass line 7, thereby allowing the choke valve 10 to remain fully open. By operating the choke valve 10 in the fully open position, erosion to the choke valve 10 internals is minimized, and the relatively low cost upstream orifice 8 becomes the sacrificial wear component.

In the preferred embodiment, the upstream orifice 8 is a bit jet flow restrictor. To size the bit jet restrictor 8, the surface transmitter 6 is brought on-site and hooked up with a nominal size restrictor 8 in the bypass line. Then the choke valve 10 is opened and the pressure is read at the standpipe 16 to determine how much fluid is being bypassed. To change the bypass quantity, a smaller or larger bit jet 8 is installed. The bit jet 8 is housed in a manifold assembly 27 and can be quickly changed via the access plug 5. The bit jet 8 is preferably a tungsten carbide nozzle with an orifice through the middle, and it is preferably located on the upstream side of the choke valve 10. By locating the bit jet 8 upstream of the choke valve 10, the bit jet 8 provides a reflection surface for the instantaneous positive pulses, or increases in pressure, created when the choke valve 10 is rapidly closed. These positive pulses would interfere with the uplink pulses if the bit jet 8 were not located upstream of choke valve 10.

Flow diverter 9, which is downstream of the bit jet 8, is preferably bullet-shaped, or otherwise shaped to streamline the flow as it moves past the flow diverter 9. The flow diverter 9 preferably includes a coating that resists wear, such as tungsten carbide, ceramic, or diamond composite. The flow diverter 9 may alternatively be constructed of a material that resists wear, such as solid tungsten carbide, solid ceramic, or solid Stellite. Flow diverter 9 forces the turbulent, high velocity flow that exits the bit jet 8 into a normal flow regime before entering the choke valve 10. Without the diverter 9, the drilling fluid would erode the internals of the choke valve 10 due to the high velocity exiting the bit jet 8.

Downstream of the choke valve 10 is a much larger and permanent orifice 11, preferably another bit jet, sized to match the control factor of the choke valve 10 so as to provide adequate back pressure to prevent cavitation in the choke valve 10 as the drilling fluid flows therethrough.

Figure 2A:
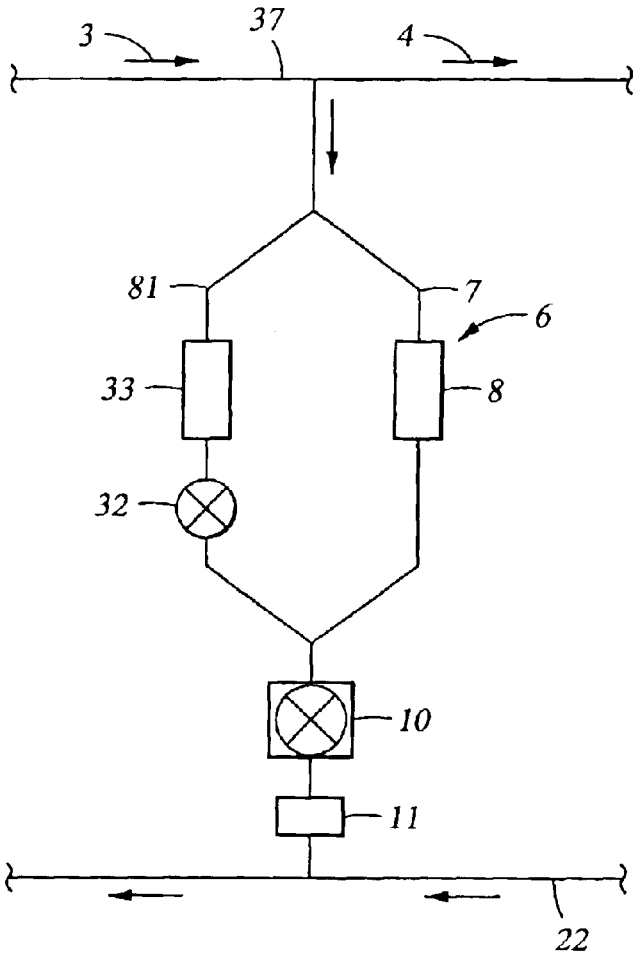
FIG. 2A is a schematic depicting an alternative transmitter assembly employing a dual-line bypass system.

Referring now to FIG. 2A, there is depicted an alternative embodiment of the surface transmitter assembly 6 utilizing a dual bypass system rather than a single bypass system. The dual bypass transmitter incorporates two parallel bypass lines 7, 81. The same bit jet restrictor 8 is provided on the first bypass line 7, and another bit jet restrictor 33 is provided on the second line 81. A valve 32, which may be a ball valve, is also positioned on the second line 81 to control whether flow moves through line 81 when the choke valve 10 is opened. Valve 32 may be manually operated, but preferably utilizes an actuator and control system, such as the pneumatic actuator 13 operated by surface control system 90 (further described below) that is used for actuating choke valve 10. This ball valve 32 acts as an on/off "switch" with respect to activating the second line 81 of the bypass. Thus, the dual system acts as a variable or 2-position flow restrictor. A high "resistance" flow restriction is created by shutting ball valve 32 to close off the second line 81 of the bypass system, while a low "resistance" flow restriction is created by keeping the second line 81 open to allow more flow to be bypassed. This system can also be expanded, if desired, to include additional bypass lines.

The benefit of this dual bypass system is that the operator may generate high frequency and low frequency pulses having the same amplitude, without bypassing too much fluid in either circumstance. By switching between high and low "resistance" flow restriction, long and short pulses having the same amplitude can be generated. When a low frequency pulse is desired, the ball valve 32 remains closed, and flow passes only through the first bypass line 7 as the choke valve 10 is opened and closed. When a high frequency pulse is desired, the ball valve 32 is opened prior to opening the choke valve 10 and bypass is provided through both lines 7, 81 while the choke valve 10 is cycled open and closed.

Figure 2B:
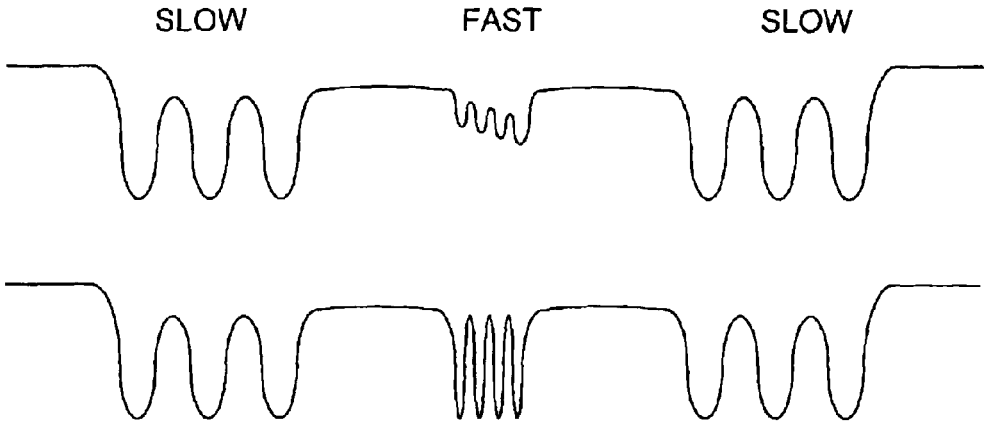
FIG. 2B includes an upper graph and a lower graph, each graph depicting a slow-fast-slow pulse signature when the second line of the bypass system of FIG. 2A is not used, and when it is used, respectively.

Referring now to the two graphs depicted in FIG. 2B, the top graph illustrates how a slow-fast-slow pulse signature would appear to the downhole receiver 21 when the second bypass line 81 is not in use. The low and high frequency signals have a great difference in amplitude. The bottom graph of FIG. 2B shows the same slow-fast-slow pulse signature when the second bypass line 81 is in use. Here, the low and high frequency signals have a different pulse width but have the same amplitude. Having slow and fast pulses with the same amplitude allows for a simpler detection algorithm while improving the likelihood that those pulses will be detected downhole.

Surface Transmitter Control System

Figure 3:
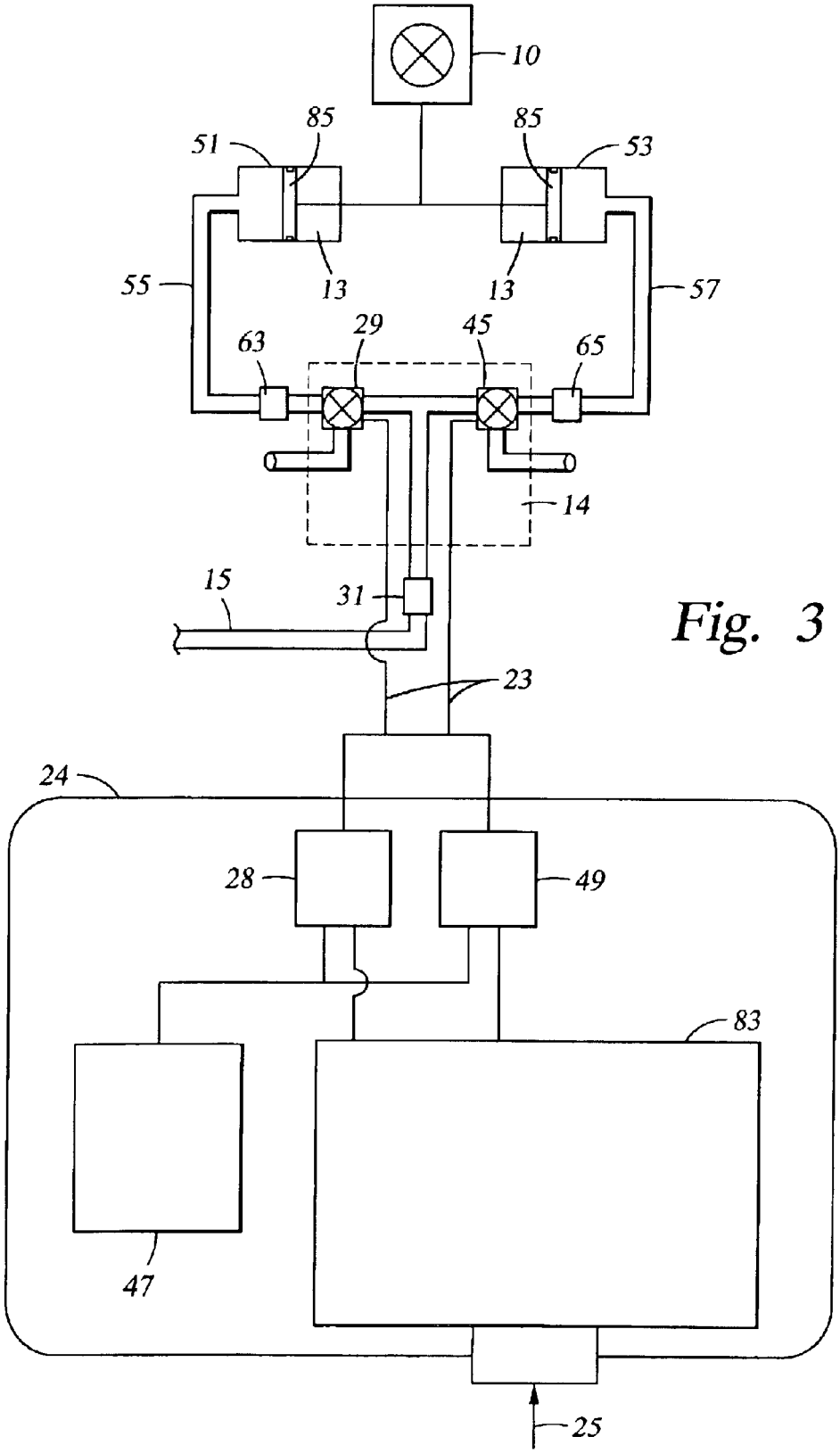
FIG. 3 is a detailed schematic of a control system for operating a transmitter assembly.

Referring now to FIGS. 1 and 3, the surface transmitter assembly 6 is operated by a surface transmitter control system 90 comprising a computer 26, a downlink controller/barrier box 24, and an intrinsically safe pneumatic control box 14 housing two intrinsically safe solenoid valves 29, 45. The solenoid valves 29, 45 are preferably ASCO Model Number WPIS8316354 valves with ⅜" NPT connections and 150 psi maximum differential pressure.

The computer 26 controls the actual timing for generating the series of pulses by opening and closing the choke valve 10. The operator inputs an instruction to the computer 26 using a graphical user interface screen. The computer 26 encodes the downlink instruction into the timing sequence used to control the choke valve 10. That encoded instruction is transmitted to the downlink controller/barrier box 24 via a RS232 cable 25. The downlink controller/barrier box 24 houses a downlink controller 83, preferably a micro-controller board, along with a power supply 47 and two intrinsically safe solenoid drivers 28, 49. The power supply 47 is preferably a SOLA Model Number SCP30D524-DN 5V, 24V O/P. The downlink micro-controller board 83 converts the computer command signals to zero to five volt logic signals to control the intrinsically safe solenoid drivers 28, 49 that are preferably Pepperl & Fuchs Model Number KFD2-SL-Ex1.48.90A with a maximum current rating of 45 mA at 30 volts DC power. The solenoid drivers 28, 49 send intrinsically safe 24 volt DC power signals to the pneumatic control box 14 via the shipboard rated cable 23. Inside the pneumatic control box 14, the 24 volt DC power signals activate two intrinsically safe solenoid valves 29, 45 that control the air supply 15 that operates the pneumatic actuator 13 to open and close the choke valve 10.

The two solenoid valves 29, 45 are independent from one another and are connected via quick connect fittings 63, 65 to lines 55, 57 that direct air to the pneumatic actuator 13. The two solenoid valves 29, 45 are constantly supplied with air pressure via the rig air supply 15, but they await signals from the downlink controller 83 before actuating. The pneumatic actuator 13 includes two air chambers: the "open" chamber 51 and the "close" chamber 53. Each chamber 51, 53 is connected to opposite sides of the actuator piston 85 which activates choke valve 10 such that when a solenoid valve 29, 45 opens, air flows through one of the high pressure lines 55, 57 into either the open chamber 51 to open the choke valve 10 or into the close chamber 53 to close the choke valve 10. In this manner, the choke valve 10 is either fully opened or fully closed to allow a bypass stream into the bypass line 7.

Figure 4:
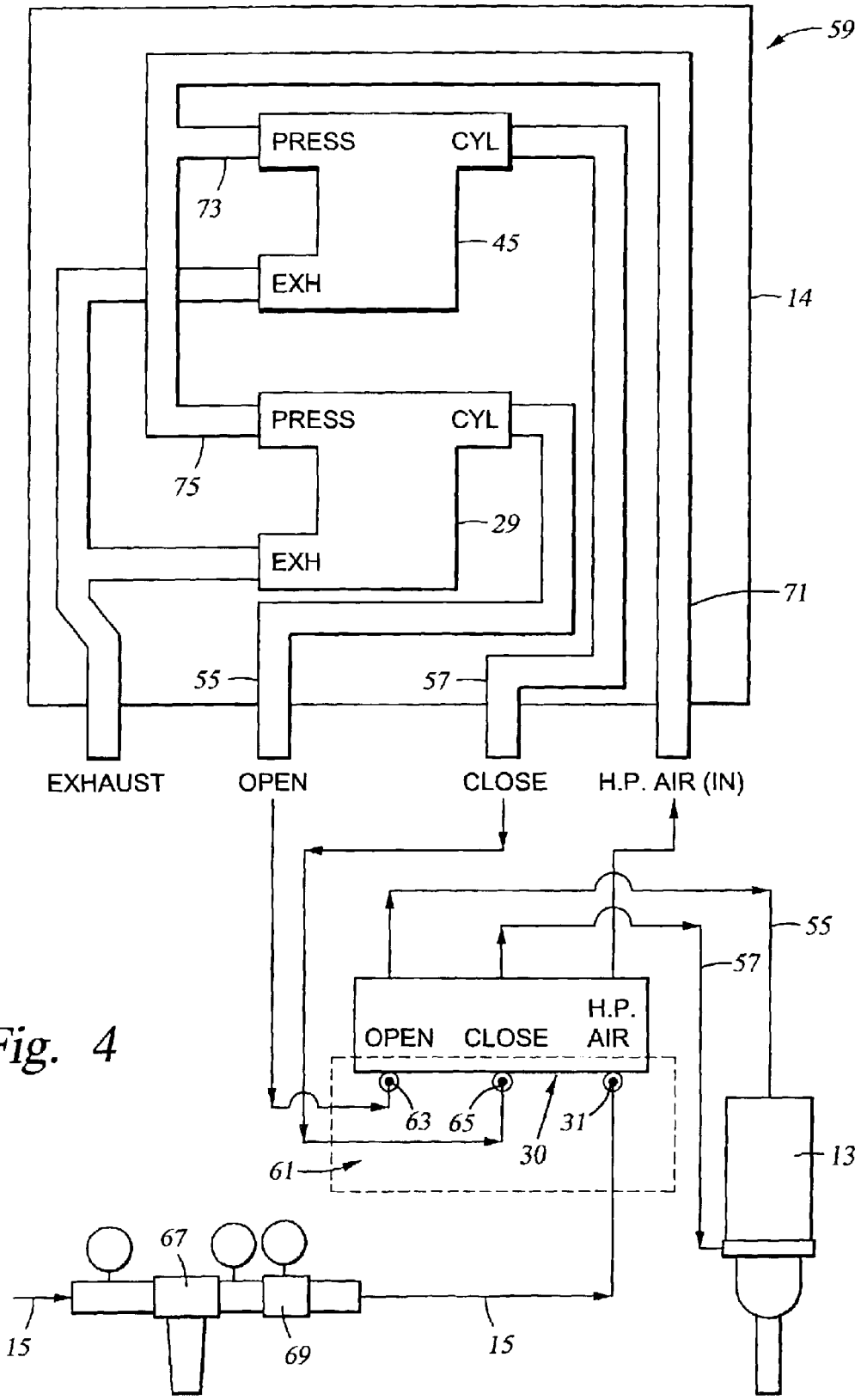
FIG. 4 is a detailed schematic of a pneumatic control system for operating a pneumatic actuator of a choke valve.

FIG. 4 provides a more detailed diagram of the pneumatics system 59 used to open and close the choke valve 10. The pneumatics system 59 includes the pneumatic control box 14 that contains the open and close solenoid valves 29, 45, which are connected to the rig high-pressure air line 15. The pneumatic system 59 also includes a manual override air system 61, which is preferably a manifold 30 provided with three quick connect fittings 31, 63, 65. This system allows for the choke valve 10 to be manually operated if the controller system fails.

Under normal operating conditions, the supply of air from the rig 15 is filtered by filter 67 and regulated by regulator 69 so that the pressure is controlled and the air is kept dry. The regulated and dried air flows from the rig supply line 15 through the override manifold 30 at quick connect fitting 31 and into the high pressure side 71 of the pneumatics system 59 to the "open" and "close" solenoid valves 29, 45 housed within the control box 14. If the "open" solenoid 29 is actuated, the air flows through line 71, enters the solenoid 29 through line 75, flowing into the override manifold 30 through quick connect fitting 63, and into line 55 to the actuator 13. Similarly, if the "close" solenoid 45 is actuated, the air flows through line 71, enters the solenoid 45 through line 73, flowing into the override manifold 30 through quick connect fitting 65, and into line 57 to the actuator 13.

In the event of a control system failure, the pneumatic actuator 13 can be manually actuated by quick coupling the regulated air supply line 15 to the open or close quick connect fitting 63, 65 on the override manifold 30. Thus, the manifold 30 and the quick connect fittings 31, 63, 65 allow for the high-pressure line 15, connected at 31, to be disconnected from the manifold 30 and connected to either the open fitting 63 or the close fitting 65 to manually operate the actuator 13. This allows the choke valve 10 to be opened or closed if the control system fails.

Figure 5:
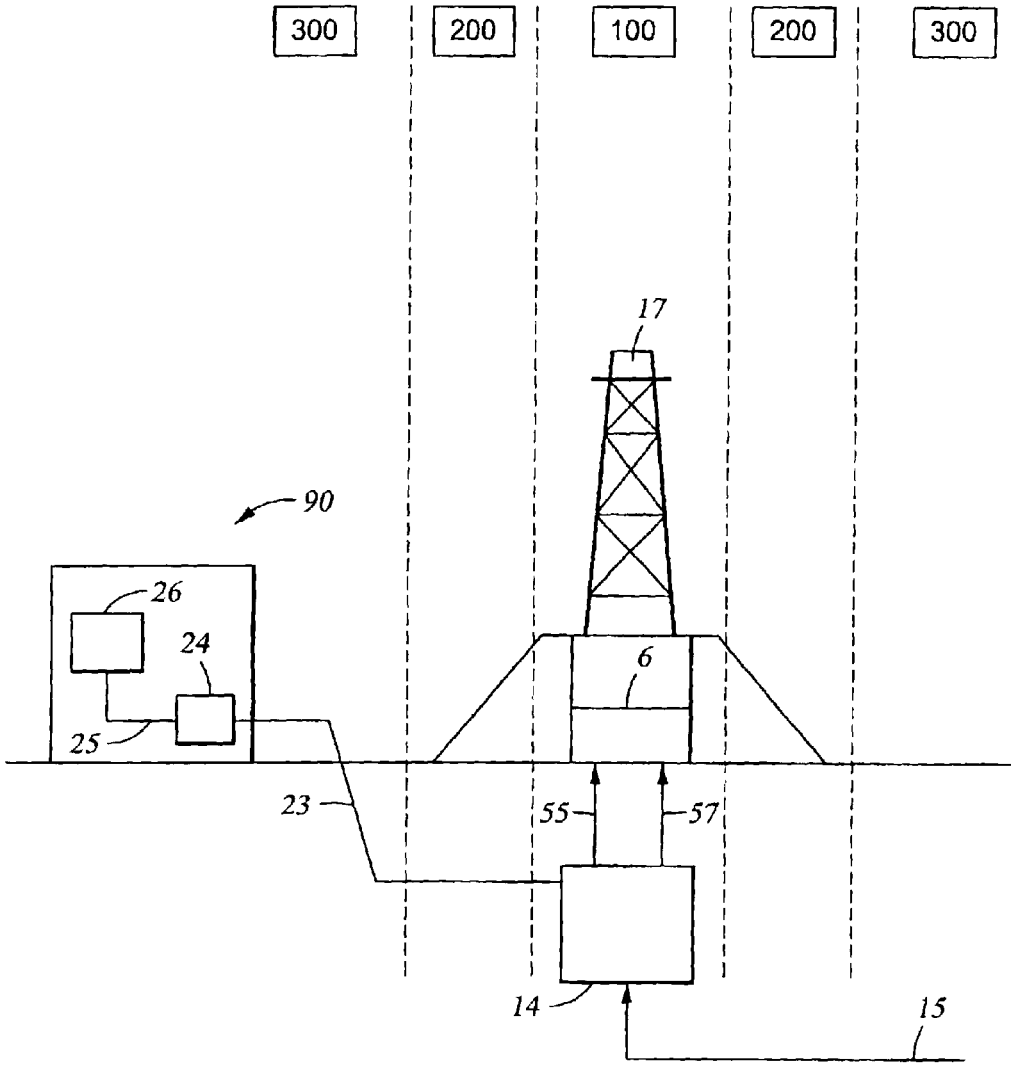
FIG. 5 is a schematic depicting electrical code zones and the locations of the downlink telemetry system components within those zones.

Referring now to FIG. 5, this diagram depicts the relative positions of the surface transmitter assembly 6 and the surface transmitter control system 90 with respect to the drilling rig 17. The zones labeled 100, 200 and 300 each correspond to intrinsic safety code zones as follows:

100=Class I, Division I, hazardous zone (Zone 1)

200=Class I, Division II (Zone 2), and

300=Class I, Division III, non-hazardous zone (Zone 3).

The drilling rig 17 is located in the hazardous zone 100, corresponding to Class I, Division I. When the choke valve 10 is operated by a pneumatic or hydraulic actuator 13, the surface transmitter skid 6 may also be located in the hazardous zone 100. However, when the choke valve 10 includes an electrical actuator 13, the transmitter skid 6 may need to be located in the non-hazardous zone 300. The preferred embodiment utilizes a pneumatically actuated choke valve 10 that is connected by high-pressure lines 55, 57 to the intrinsically safe solenoid valves 29, 45 housed within the weather tight pneumatic control box 14 that is part of the control system 90. In the preferred embodiment, as shown in FIG. 5, the transmitter skid 6 and the control box 14 are both located in the hazardous zone 100. The computer 26 and downlink controller/barrier box 24 are located in the non-hazardous zone 300 of the rig site. The downlink controller/barrier box 24 that houses the downlink controller 83 is connected to the surface transmitter assembly 6 by the shipboard rated cable 23 that traverses all three zones 100, 200, 300. The downlink controller/barrier box 24 and the computer 26 are located in a shelter or skid and connected together via a RS232 cable 25.

Downhole Receiver

Referring again to FIG. 1, another component of the downlink telemetry system is the downhole receiver 21 disposed within the downhole assembly 35. The downhole receiver 21 includes a microprocessor and a flow meter, such as a Venturi or turbine flow meter, or a pressure sensor, such as a pressure transducer. The preferred design utilizes a standard pressure while drilling tool, such as Sperry Sun's PWD® tool, with modified software. The downhole receiver 21 works in conjunction with a master controller 34 disposed in the downhole assembly 35. The telemetry scheme and algorithm for decoding the downlink signals are programmed primarily into the downhole receiver 21. The master controller 34 completes the signal decoding and distributes the downlink instructions to the appropriate tool within the downhole assembly 35.

Operational Overview

Referring still to FIG. 1, in operation, pressure pulses are sent from the earth's surface by the transmitter assembly 6 down the drill string 19 to be received by the downhole receiver 21. Assume that the pump 2 moves drilling fluid out of the fluid reservoir 1 into the pump discharge line 37 along path 3 at a rate of 400 gallons per minute (GPM). Next assume that the choke valve 10 is momentarily opened to allow 50 GPM to run through the bypass line 7, into the pump return line 22, and back to the fluid reservoir 1. Meanwhile, drilling fluid flowing at 350 GPM travels along path 4 in the direction of the flow arrows through the standpipe 16, down the drill string 19, into the annulus 18, and back to the fluid reservoir 1 through the pump return line 22. In total, after accounting for the time lag associated with the fluid moving through the system, 400 GPM leaves the pump 2 along path 3, and 400 GPM returns to the fluid reservoir 1, with 50 GPM going through the bypass line 7 and 350 GPM going downhole. The downhole receiver 21 will detect a drop in fluid pressure and/or flow rate for the duration that the choke valve 10 is open. Hydraulic pressure drop across a flow restrictor is related to the flow rate by the following equation:

$$\Delta P = Q^2 \times R$$

Where P is pressure,
Q is flowrate, and
R is resistance to flow.

The magnitude of the drop in fluid pressure, at the downhole receiver 21, is related to the change in flow through the drill string 19 by the following equation:

$$|\Delta P_{PULSE}| = (Q_C^2 - Q_O^2) \times R$$

Where $Q_C$ is the flow rate through the drill string 19 when the choke valve 10 is closed;

$Q_O$ is the flow rate through the drill string 19 when the choke valve 10 is open; and R is the resistance to flow downstream of the downhole receiver 21.

Even a small change in flow rate will cause a measurable change in downhole pressure at the downhole receiver 21. Each time the choke valve 10 is opened and then closed, a negative pulse, or decrease in downhole pressure, is detected by the downhole receiver 21.

Figure 6:
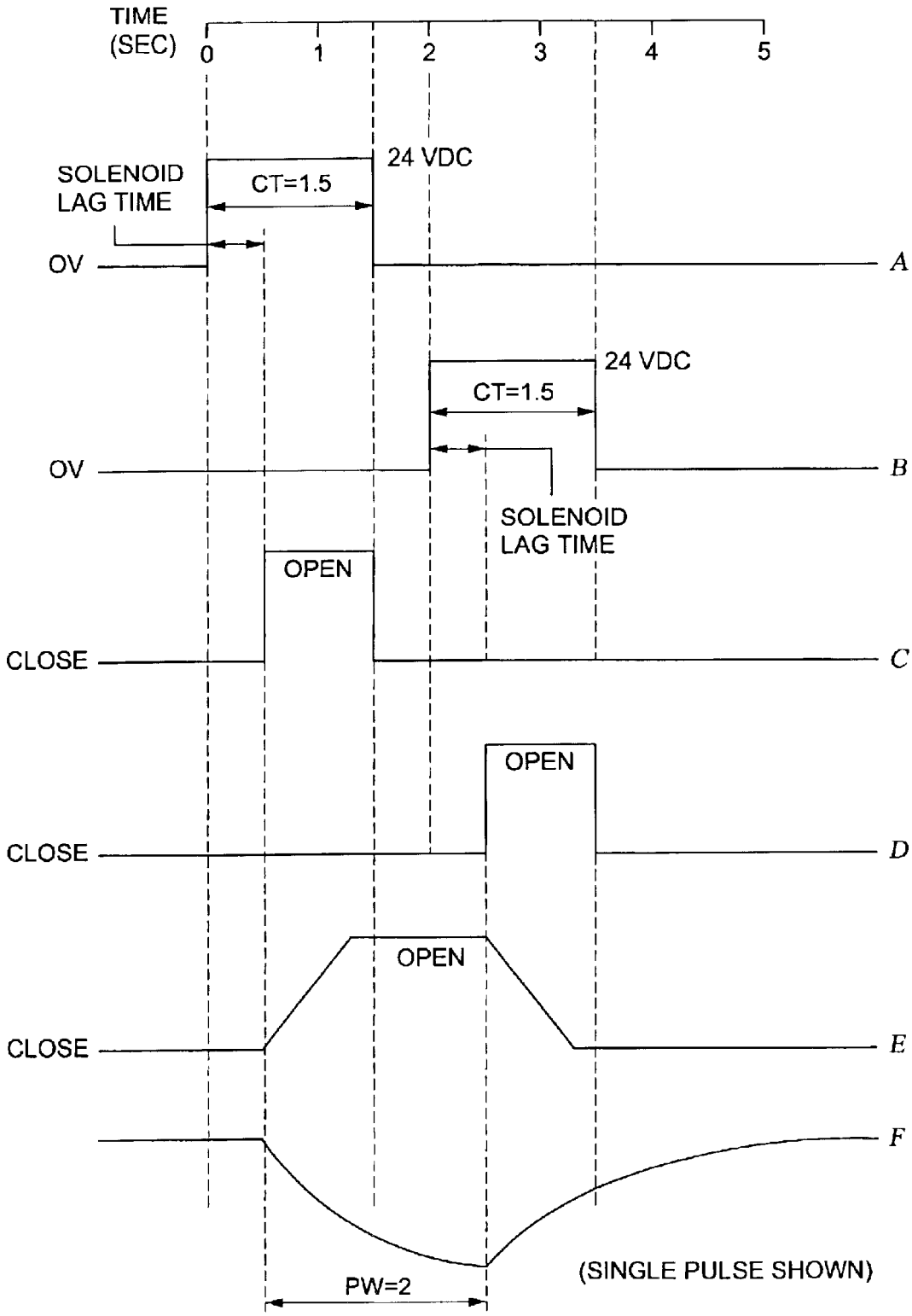
FIGS. 6A and 6B provide graphs of the power being supplied to open and close solenoid valves, respectively, as a function of time.
FIGS. 6C and 6D provide graphs of the position as a function of time for open and close solenoid valves, respectively.
FIG. 6E provides a graph of the position of a choke valve as a function of time.
FIG. 6F provides a graph of downhole pipe pressure as a function of time.

Referring now to FIGS. 6A–6F, the operation and timing of the choke valve 10 and the controlling solenoid valves 29, 45 are graphically depicted. FIG. 6A shows the power supplied via the "open" solenoid driver 28 to the "open" solenoid valve 29, and FIG. 6B shows the power supplied via the "close" solenoid driver 49 to the "close" solenoid valve 45. FIG. 6C shows the position of the "open" solenoid valve 29, and FIG. 6D shows the position of the "close" solenoid valve 45 with respect to time. FIG. 6E shows the position of the choke valve 10 with respect to time, and FIG. 6F shows the resultant pipe pressure as measured at the downhole receiver 21 with respect to time.

Referring now to FIG. 6A, as power is supplied to charge the coil of the "open" solenoid 29, there is approximately a 0.5 second lag before the solenoid 29 is energized. At time=0, a zero to five volt logic signal is received from the downlink controller 83, and the "open" solenoid driver 28 supplies 24 volt DC power to activate the solenoid valve 29. The power is applied to charge the solenoid valve 29 for 1.5 seconds, including about a 0.5 second lag time and about 1 second energized time for activating the "open" solenoid valve 29. The solenoid valve 29 essentially opens instantaneously as shown in FIG. 6C and remains open for 1 second while air is supplied to the "open" side of the choke valve actuator 13 at chamber 51. As shown in FIG. 6E, during that 1 second time frame, the choke valve 10 gradually opens for 0.8 seconds and air is supplied to chamber 51 for the remaining 0.2 seconds to ensure the choke valve 10 is fully open. As shown in FIG. 6C, when the 1.5 second charge time has passed, the "open" solenoid valve 29 snaps shut.

Referring to the graph in FIG. 6B, approximately 0.5 seconds later, or at time=2 seconds, a 24 volt DC power supply is provided by the "close" solenoid driver 49 to activate the "close" solenoid valve 45. Again, there is approximately a 0.5 second lag time before the "close" solenoid valve 45 is opened. The "close" solenoid valve 45 opens instantaneously as shown in FIG. 6D and remains in the open position for 1 second to provide air to the "close" chamber 53 of the choke valve actuator 13. As shown in FIG. 6E, during this 1 second period, the choke valve 10 closes in approximately 0.8 seconds and air is applied to chamber 53 for the remaining 0.2 seconds to ensure the choke valve 10 is fully closed. Then the "close" solenoid valve 45 snaps shut as shown in FIG. 6D.

Referring to the graph in FIG. 6F, this opening and closing of the choke valve 10 produces a drop in the pipe pressure, or a negative pulse, having a pulse width of 2 seconds between time t=0.5 and t=2.5. The characteristic response time of the solenoids 29, 45 and choke valve 10 were determined experimentally during testing given the physical limitations of the components.

To send an entire instruction, the choke valve 10 is opened and closed in a predetermined set pattern to create momentary changes in pressure downhole that the downhole receiver 21 recognizes as a series of negative pulses. One advantage of the present invention is that drilling does not have to be shut down each time an instruction is sent downhole. The 50 GPM drop in the drilling flowrate due to fluid being diverted through the bypass 7 does not substantially impact the drilling operation. Although the downlink telemetry system has the advantage of not shutting down drilling operations while sending signals, the drilling operation is affected when fluid is bypassed for downlinking signals. When the drilling tool is deep within the formation, larger amplitude pulses are required to transmit the signals downhole, requiring a greater amount of fluid to be bypassed. In such circumstances, the downhole drilling operation may temporarily stall. Therefore, it is advantageous to send and receive the signals as quickly as possible.

When the downhole receiver 21 reads a series of pulses, an inventive algorithm that controls the downhole receiver 21, described in more detail below, recognizes the pulse signatures and determines the period of time between the negative pulses created by changes in downhole pressure. Then the algorithm converts the time periods, or intervals, between the negative pulses back into the instruction being sent downhole. In this way, the downhole receiver 21 interprets the signal to determine what instruction is being sent downhole. Thus, in summary, the downhole receiver 21 recognizes the negative pulses caused by momentary changes in downhole pressure, then the algorithm determines the time, or interval, between those pressure changes, and from those intervals, interprets the instruction that is being sent.

Once the algorithm decodes the instruction, the master controller 34 housed in the downhole assembly 35 determines which particular tool the instruction is directed to through the use of a lookup table. The master controller 34 then distributes the instruction to that tool, and the particular downhole tool is thereby controlled and changed as a result of the signals being sent. For example, a typical downhole assembly might house a 3-D rotary steerable drilling tool and a suite of formation evaluation tools designed, for example, to measure resistivity of the formation, porosity of the formation, or sense gamma radiation. The master controller 34 may, for example, send instructions to the 3-D drilling tool telling the drill bit how much to deflect and in which direction to point the toolface. Or, for example, if the instruction is being sent to a formation evaluation tool, the command might instruct the tool to change modes of measurement or to turn on or off depending on what formation is being entered.

Due to the relative high speed downlink signaling and data processing that can be achieved, real time instructions can be sent and selectively verified via uplink signals to allow for quick adjustments to the downhole tool. Real advantages are achievable by combining 3-D rotary steerable drilling tools with the high-speed downlink telemetry system of the present invention. A 3-D steerable tool is capable of making incremental changes in direction in response to downlink instructions, whereas most previous downhole drilling tools made only macro changes because they included only an on or off mode, and an inclination that was either full or none. Further, traditional downlink signaling required temporary cessation of drilling to cycle the pumps on/off to send instructions to the drilling tool. Therefore, such instructions could only be sent periodically if any forward progress was to be made in drilling. The result of using such prior art drilling tools in combination with slow downlink signaling was horizontal boreholes with snake-like profiles rather than accurately located ones as operators attempted to adjust the drilling tool at various points along its path to account for the tool being off track. The net effect was a borehole that remained on course with respect to the starting and ending points, but with a snake-like or tortuous path in between. When a tortuous borehole is drilled, the pipe being pushed or pulled into the hole tends to get stuck since it takes significantly more force to slide a long section of pipe through a tortuous hole than through an accurately located borehole that is optimized for minimum drag.

In contrast, by using a 3-D steerable drilling tool in combination with the present downlink telemetry system, the drilling tool can continuously make incremental changes to the deflection angle and to the tool face in response to the rapidly downlinked signals transmitted while drilling continues. Therefore, as the 3-D tool is drilling the borehole, the tool is continuously being sent signals and adjusting direction appropriately to stay on course. Theoretically, then, an accurately located borehole can be achieved, or one that is significantly more accurately located and optimized for minimum drag than the boreholes drilled with an on/off tool in combination with a slow downlink command structure, or drilled by incrementally adjustable tools limited by a slow downlink command structure.

Another feature of the downlink telemetry system is the use of bi-directional communication. Bi-directional communication allows downlink and uplink signals to be sent at the same time without interference between the two signals. Such interference is avoided by sending downlink and uplink pulses within different frequency bands. For example, the uplink pulses may have a high frequency, while the downlink pulses may have a low frequency. Good detection results have been achieved when the uplink pulse frequency is in the range of five to ten times higher than the downlink pulse frequency, and the greater the variance in frequency, the less the likelihood of interference. To create the downlink signals, a bit jet 8 of a certain size is provided to create the desired downlink signal amplitude, and the choke valve 10 is opened and closed at a rate such that the desired frequency of pressure pulses is created. Thus, the downlink pulse frequency is adjustable and is set depending upon the drilling conditions and the frequency of the uplink signal. The downhole receiver 21 recognizes the pulses as a downlink signal due to the frequency of the signal.

Although bi-directional communication is achievable using mud pulse telemetry for both uplink and downlink signaling, other types of telemetry schemes may be used, or a combination of telemetry schemes may be used. For example, assuming downlink signals are generated using mud pulse telemetry, uplink signals may be generated using another type of telemetry, such as electromagnetic telemetry, for example, or vice versa. If the telemetry media is the same for uplink and downlink signaling, then the frequency band of the uplink and downlink signals must be sufficiently different to achieve bi-directional communication.

The detection algorithm of the present invention that is located downhole is capable of processing higher frequency downlink signals as compared to those of the prior art. Typical prior art algorithms require very long, low frequency downlink pulses to process a downlink instruction. The algorithm of the present invention is capable of interpreting 1 bit of information approximately every 2–7 seconds. This rate of downlink signaling is significantly faster than known prior art systems, allowing for 4 instructions to be sent downhole in the same period of time that it takes prior art systems to send 1 instruction. Thus, the detection algorithm of the present system allows for relatively higher frequency downlink signaling.

The downlink telemetry system is adjustable such that the downlink signal may be sent at any frequency with respect to the uplink signal. Theoretically, the downlink telemetry system of the present invention can be used with any uplink system to achieve bi-directional communication. If the telemetry media is the same for uplink and downlink signaling, then the frequency band of the uplink and downlink signals must be sufficiently different to achieve bi-directional communication. The difference in frequency bands between the uplink and downlink signals enables the uplink receiver 39 to filter out the downlink signal and enables the downlink receiver 21 to filter out the uplink signal. Bi-directional communication provides the advantage of continuous communication between the surface and the downhole tools such that adjustments can be made quickly while continuing to drill.

Telemetry Scheme and Algorithm

The telemetry scheme and algorithm are used by the downhole receiver 21 and master controller 34 to decode the downlink signals into instructions to be distributed to components of the downhole assembly 35. The algorithm is a computer program, and may be encoded using any well-known programming language such as, for example, C programming language. The algorithm is downloaded into a microprocessor within the downhole assembly 35.

Pulse position modulation (PPM) format, which is a published, standard communication protocol known in the art, is used for coding the downlink signals. Although any data coding format or modulation scheme is suitable, PPM is preferred because it does not require continuous pulsing versus other telemetry schemes that send signals continuously. When continuous pulsing is required, the choke valve 10 must constantly be actuated, thus causing more wear on the surface transmitter. Therefore, PPM is advantageous due to less wear and tear on the equipment.

Figure 7:
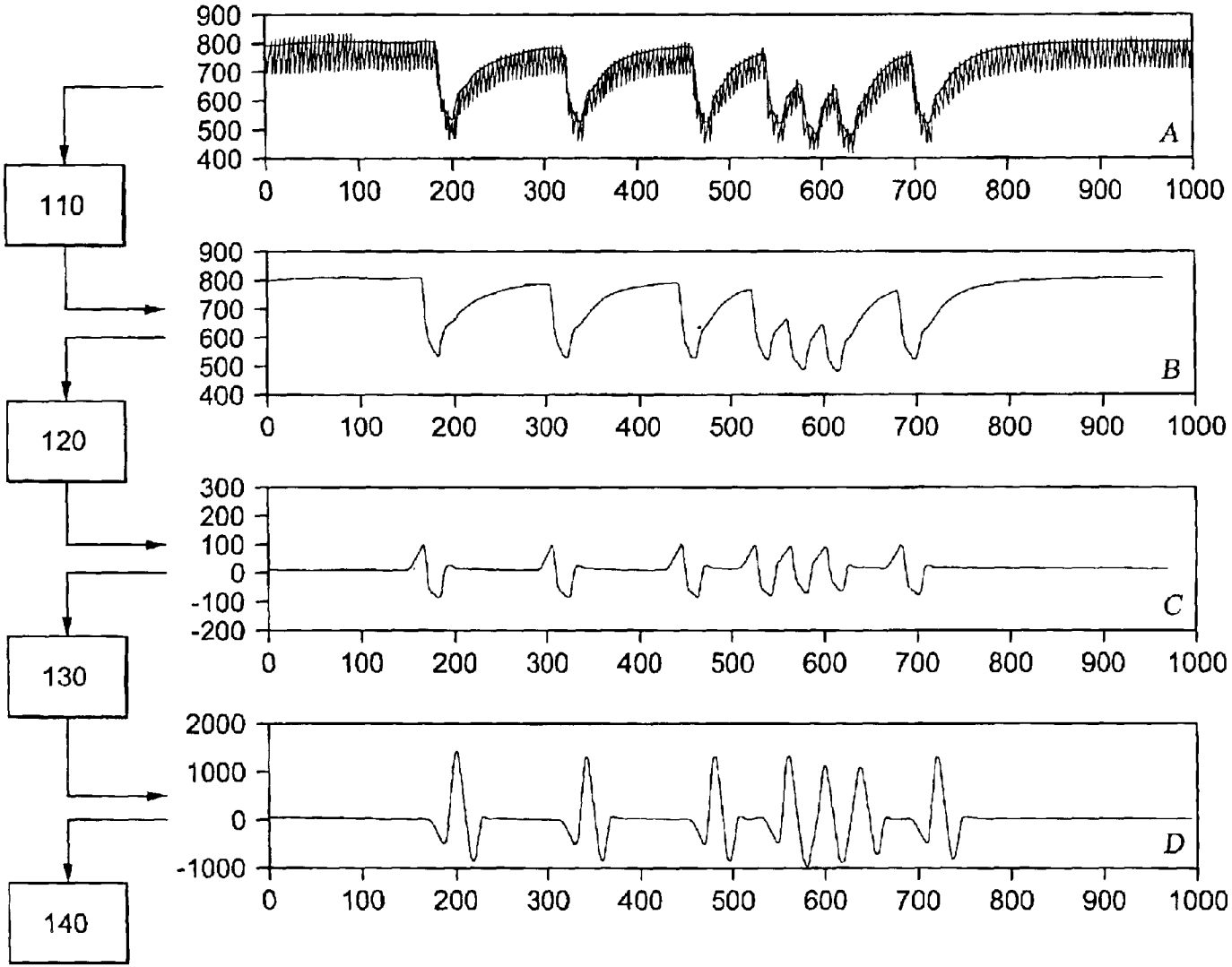
FIG. 7 depicts a flow diagram of the downhole filtering and algorithm scheme, with FIGS. 7A–7D showing graphs of the input and output signals to each flow diagram step.

FIG. 7 depicts, in graphical format, the method used by the downhole receiver 21 to identify the instructions being sent. A simple flow diagram is shown along the left side of FIG. 7 to depict how the downhole receiver 21 filters the signal at each step before the algorithm decodes the signal into an instruction to be distributed to the proper downhole tool. The graphs shown in FIGS. 7A–7D are input and output signals to each of the filtering and algorithm steps of the flow diagram.

FIG. 7A depicts the raw signal first received downhole by the receiver 21. Large amplitude, lower frequency downlink pulses are depicted with small amplitude, higher frequency uplink pulses overlapped onto the downlink signal waveform. Also included in these signals is steady-state pressure, and noise from the pumping and drilling operation.

A number corresponding to time (t) is plotted on the horizontal or X-axis. The signal amplitude corresponding to pressure is shown on the vertical or Y-axis. The time corresponding to each sample point is based on the sampling frequency, which can vary depending upon the pulse width and frequency of the downlink signal. For this example, each sample point on the horizontal axis corresponds to 0.2 seconds because the digital signal is sampled at 5 Hertz (Hz). Thus, at approximately X=200, where t=40 seconds, a dip in pressure or negative downlink pulse is shown that is generated by opening and then quickly closing the choke valve 10 at the surface as previously described. Once the choke valve 10 is closed, the pressure will gradually return to steady state pressure. At approximately X=300, where t=60 seconds, the choke valve 10 is again opened and closed to produce another downlink pulse. Between X=500, where t=100 seconds, and X=750, where t=150 seconds, the time between downlink pulses is short, which does not allow for the pressure to fully recover to steady state. However, filtering steps 110, 120, 130 and algorithm 140 recognize the shape of these pulses as downlink signals regardless of whether the pressure returns to steady state. Thus, FIG. 7A graphically depicts the raw signal at the downhole receiver 21, and this digitized signal is sampled and then passed through a median filter at step 110 to remove the uplink pulses. In FIG. 7A, the high frequency signals shown superimposed on the downlink pulses are uplink pulses, not noise associated with drilling and pumping.

FIG. 7B shows the filtered output from the median filter with all the uplink pulses having been filtered out. The median-filtered signal is fed into a band pass filter, preferably a finite impulse response (FIR) filter at step 120, which causes a linear phase response. The FIR filter removes any high frequency noise created by the drilling operation and pump 2. The FIR filter also removes the DC component of the signal corresponding to the base or steady-state pressure as shown in FIG. 7C. Removing the DC signal is important for the next phase of filtering, cross-correlation, because the signal of interest does not have a DC component.

FIG. 7C shows the filtered output from the FIR filter, which is the downlink signal corresponding to the change in pressure associated with the choke valve 10 opening and closing. Once the downlink pulses have been filtered to produce the signal shown in FIG. 7C, a known template signal is applied to the FIR-filtered signal in the cross-correlation step 130. The template signal is selected such that the waveform of the template signal matches fairly closely to the waveform of the signal to be detected. The preferred embodiment of the present invention employs a bipolar square wave template with half of the square wave points having a +1 value on the Y-axis and half of the square wave points having a −1 value on the Y-axis. The total number of template signal points depends on the pulse width, and for a 2 second pulse width, the bipolar square wave template preferably comprises 30 total points.

Through a known mathematical method called cross-correlation, the FIR-filtered signal shown in FIG. 7C is correlated to the template signal to determine the exact time when each pressure pulse occurred along the X-axis. A square wave was selected as an approximation to the signature of the pulse for ease of calculation, since the downhole assembly 35 may employ a simple processor, such as an 8-bit master controller 34. The square wave also easily converts into a fixed-point format. Therefore, an assumption is made that a pulse will be approximately shaped like a square wave for purposes of cross-correlation at step 130.

Thus, through cross-correlation, the signal is compared to the template to generate the signal profile shown in FIG. 7D. The cross-correlation step 130 also removes the white noise that might be associated with the FIR-filtered signal shown in FIG. 7C. The output from the cross-correlation step 130 is the processed signal shown in FIG. 7D.

The processed signal of FIG. 7D is passed through an algorithm 140 that identifies any time when a sample point exceeds a set threshold amplitude or Y-axis value. When a sample point exceeds the threshold amplitude, the algorithm 140 recognizes that a downlink pulse has occurred and locates the time position of the cross-correlation peak along the X-axis. The field engineer sets the threshold amplitude based on experience, which may be set, for example, at approximately 1,000 in the case of the processed signal of FIG. 7D. To determine the proper threshold amplitude, the algorithm 140 is first supplied with a default threshold, usually set at a low amplitude before the operator determines the most appropriate threshold amplitude. The assembly 35 is communicating with the surface receiver 39 through the uplink signal to verify the threshold amplitude and to verify the peak cross-correlation pulse amplitude. These uplink signals provide information to the operator for determining if the threshold amplitude should be reset. The operator must compromise between a threshold that is set too low such that noise is detected that can be confused for a downlink pulse, and a threshold that is set too high such that the downhole receiver 21 may miss an instruction altogether. To reset the threshold, a downlink pulse sequence representing an instruction to modify the threshold setpoint can be sent downhole just like any other instruction, or once the drilling assembly 35 is brought back to the surface, the threshold can be reset before the next drilling run.

Using the processed signal of FIG. 7D, the algorithm 140 determines the time between two cross-correlation pulses by locating the peak of each cross-correlation pulse along the time or X-axis. The time between two cross-correlation pulse peaks is called an interval, and the downlink instructions are sent in an interval format. Referring now to FIG. 8, there is shown a flowchart of the algorithm 140 steps for locating the cross-correlation pulse peaks. The algorithm 140 includes two detection states: SCAN state 150 and CHECK state 160. In general, in the SCAN state 150, the algorithm 140 compares each sample point in the processed signal of FIG. 7D to the threshold value. When the algorithm 140 locates a sample point that equals or exceeds the threshold value, the algorithm 140 switches into the CHECK state 160. Then the algorithm determines the highest sample Y-value, which is the cross-correlation pulse peak, and the corresponding sample X-value, which is the time associated with the cross-correlation pulse peak from which the interval between two cross-correlation peaks can be calculated.

More specifically, to locate a cross-correlation pulse peak, a default threshold Y-value is input at 144. In the SCAN state 150, the algorithm 140 obtains the Y-value and X-value of the first sample point in the processed signal at 152. At 154, a comparison is made to determine if the sample Y-value equals or exceeds the threshold value. If not, the algorithm 140 returns to 152 and obtains the next sample point, again comparing the sample Y-value to the threshold value at 154. This iterative process continues until the comparison at 154 yields a sample Y-value that equals or exceeds the threshold. When that occurs, the algorithm 140 sets the Peak Value equal to the sample Y-value and sets the Peak Time equal to the sample X-value at 158.

The algorithm 140 then switches to the CHECK state 160 and obtains at 162 the next sample point. At 164, a comparison is performed to determine if the sample Y-value exceeds the Peak Value set at 158. If so, the Peak Value is set as the sample Y-value and the Peak Time is set as the sample X-value at 166. Then the algorithm 140 returns at 161 to the beginning of the CHECK state process to obtain another sample point at 162, again comparing at 164 the sample Y-value to the Peak Value set at 166. When a sample Y-value fails to exceed the Peak Value at 164, then the algorithm 140 recognizes that the Peak Value set at 166 was the highest Y-value, which is the peak of the first cross-correlation pulse. The Peak Value and Peak Time from 166 are saved at 167 for use in calculating the interval between the cross-correlation pulse peaks. The sample Y-value (that failed to exceed the Peak Value) is compared to the threshold value at 168. If the sample Y-value equals or exceeds the threshold value, the algorithm returns at 161 to the beginning of the CHECK state process to obtain another sample point at 162. If the sample Y-value does not equal or exceed the threshold value, the algorithm 140 then switches back into the SCAN state at 151 and begins the entire iterative process again to determine the Peak Time on the X-axis for the next cross-correlation pulse.

Using as an example the first two cross-correlation pulses shown in FIG. 7D, the maximum amplitude, or Pulse Peak, of both cross-correlation pulses on the Y-axis is approximately 1500, with the first Pulse Time occurring approximately at X=210, where t=42 seconds, and the second Pulse Time occurring approximately at X=350, where t=70 seconds. The threshold value determines where algorithm 140 begins to look for the Pulse Peak in the CHECK state 160. Assuming a threshold=1000 is input at 144, the algorithm 140 begins by obtaining each sample point in turn at 152 and comparing at 154 the sample Y-value to the threshold=1000 until one of the sample Y-values equals or exceeds the threshold at 154. When that occurs, such as the sample at approximately X=200, where t=40 seconds, the algorithm at 158 sets the Peak Value equal to the sample Y-value and sets the Peak Time equal to the sample X-value of X=200, where t=40 seconds.

Now in the CHECK state 160, at 162 the next sample is obtained and compared at 164 to the Peak Value that was set at 158. If the next sample Y-value exceeds the Peak Value, then the Peak Value is set to equal the sample Y-value, and the Peak Time is set to equal the sample X-value. While still in the CHECK state 160, each sample is compared to the Peak Value at step 164 to determine when the samples start to decline. When a sample Y-value does not exceed the Peak Value at 164, the algorithm 140 recognizes that the cross-correlation pulse peak was located at 166 and saves the Peak Value and Peak Time at 167 as the first cross-correlation pulse peak for later use in calculating the interval. At 168, the algorithm 140 determines whether the sample Y-value equals or exceeds the threshold of 1000. When a sample Y-value falls below the threshold of 1000 at 168, such as at X=220, where t=44 seconds, the algorithm 140 will switch back to the SCAN state at step 151. Thus, the algorithm 140 will have located the first cross-correlation pulse Peak Time at 166, which occurs at X=210, where t=42 seconds. This Peak Time is stored at 167 while the algorithm 140 locates the next cross-correlation pulse peak.

Once again in the SCAN state 150, the algorithm 140 will compare each sample Y-value to the threshold at 154 until the threshold is equaled or exceeded for the second cross-correlation pulse at X=340, where t=68 seconds. Again the algorithm 140 switches into the CHECK state 160 until it identifies at step 166 the Peak Time for the second cross-correlation pulse at X=350, where t=70 seconds. Next, the interval can be determined by subtracting the first cross-correlation pulse Peak Time from the second cross-correlation pulse Peak Time, which is 70 seconds−42 seconds=28 seconds. Thus, the duration of the first interval is 28 seconds.

Each interval communicates a certain quantity of information, which, for purposes of discussion, will be termed its VALUE. VALUE for an interval is given by the following formula:

$$\text{VALUE}'=[\text{Interval}-\text{Minimum Pulse Time } (MPT)]/\text{Bit Width } (BW),$$

$$\text{VALUE}=\text{VALUE}' \text{ rounded to the nearest integer}$$

Where MPT is the minimum time between pulses, and

BW is the resolution, which is the time required to increment or decrement a VALUE by 1.

Thus, each interval comprises a certain VALUE that depends upon the observed Interval and also upon the MPT and BW. For this example, the values chosen for MPT and BW were 8 seconds and 2 seconds, respectively. Thus, using the observed Interval calculated above, the VALUE=(28−8)/2, or VALUE=10. MPT and BW allow for downlinking signals at a fast telemetry rate without interfering with the uplink signals to permit bi-directional communication. They also provide the best performance given the optimal choke valve 10 actuation speed as described with respect to FIGS. 6A–6F. Through experimentation with these values for MPT and BW, it has been determined that encoding of three bit numbers provides optimal performance in terms of sending signals downhole quickly while still producing good detection.

To send an instruction downhole, a minimum of 3 intervals are preferred, where the first interval is the "command" interval, telling the downhole receiver 21 what tool to instruct and what type of change the tool will make; the second interval is the "data" interval, providing the magnitude of change the tool will make, and the third interval is the "parity" interval, which is the error checking portion of the instruction. For example, assuming each interval communicates 3 bits of data, each interval can range in binary value from 000 to 111, providing 8 possible VALUEs ranging from 0 to 7. While it is not necessary for the VALUE to be restricted to the range of a three bit binary number, it is advantageous to restrict the VALUE to a binary number since the downhole and surface computers internally represent numbers in binary format. By restricting the VALUE to a binary number, "control" and "data" information may be fused into one interval, or an interval may include only a fraction of datum.

Depending upon the command options available for a given instruction, the "command" may require more or less than one complete interval. Further, depending upon the data options available for a given command, the "data" may require more or less than one complete interval. Preferably, the parity comprises exactly one complete interval for each instruction. Thus, the total command+data+parity instruction may be greater than or equal to 3 intervals. For example, the processed signal of FIG. 7D comprises 6 intervals. Since the "parity" requires 1 interval, if the "command" is exactly 2 intervals, then the "data" is exactly 3 intervals, or 9 bits of information, providing data values ranging from 0 to $2^9$ (512). As a further example using the 6 intervals of the FIG. 7D processed signal, if the "command" requires 2 bits (in a 3 bit interval format), then the first interval would comprise 2 bits of "command" and 1 bit of "data." The "data" portion would also extend for 4 additional intervals. Thus, the "command" and "data" can each comprise less than one or more than one interval depending upon the particular instruction being sent downhole, while the parity comprises one complete interval regardless of the instruction.

The master controller 34 knows how many bits are associated with the "command" and how many bits are associated with the "data" based on a lookup table that is downloaded into the master controller 34 before the assembly 35 is sent downhole. To construct the lookup table, the operator determines which downhole tools will receive instructions during a given run and what types of instructions will be sent to each tool. The lookup table is formatted to contain a list of "command" VALUEs for each possible instruction and a list of "data" VALUEs associated with each command. Thus, when an instruction is pulsed to the downhole assembly 35, the algorithm 140 determines the intervals, then calculates the VALUEs for each interval to determine the instruction "command" and "data." The "command" VALUE is used by the master controller 34 in a lookup table to decode which tool is being instructed and what the tool is being commanded to do. Next, the master controller 34 uses the "data" VALUE in the lookup table to determine the magnitude of change the tool is being instructed to make for the given command. The master controller 34 then distributes the decoded instruction to the appropriate tool to make its correction.

Downlink Algorithm Example

The following is an example of an entire sequence for an instruction. Assume the operator wishes to correct the toolface deflection angle on the downhole drilling assembly 35 by +5 degrees, and the "command," "data," and "parity" for that instruction each comprise exactly one interval. The operator employs a screen on computer 26 that has a graphical user interface, and selects "toolface correction" on the screen. The operator then inputs the desired angle: +5 degrees. The computer 26 interprets that instruction and translates it into 3 intervals such that the proper pulsing sequence is sent downhole. In this case, the first interval, or "command" interval, is "toolface correction," which has a VALUE=1 in the lookup table, and the second interval, or "data" interval, is "+5 degrees," which has a VALUE=0 in the lookup table. The third interval, or the "parity" interval, is sent to verify that the downhole receiver 21 interpreted the "command" and "data" correctly. To actually decode an instruction downhole, the signal is filtered and cross-correlated as described above with respect to FIGS. 7A–7D. Then the processed signal of FIG. 7D is the input into the algorithm 140 of FIG. 8 to determine the duration of each interval.

Thus, the downhole receiver 21 detects the pulses and decodes them into intervals. Using algorithm 140, the receiver 21 detects where the peak of each cross-correlation pulse is located on the X-axis time scale and subtracts to determine the interval duration. For example, assume a 4-pulse sequence to produce the 3 intervals for the present example, where the peak of each cross-correlation pulse is located on the X-axis time scale as follows:

| Pulse 1 Peak | Pulse 2 Peak | Pulse 3 Peak | Pulse 4 Peak |
|---|---|---|---|
| 2 seconds | 12 seconds | 20 seconds | 30 seconds |

These correspond to intervals of 10 seconds, 8 seconds, 10 seconds, and the receiver 21 calculates those time intervals based on the algorithm 140 described above.

Next, the master controller 34 converts each interval into a VALUE that is used in a lookup table. Since VALUE=[Interval−MPT]/BW rounded to the nearest integer, and since in this example BW=2 seconds and MPT=8 seconds, the VALUE for each interval of the present example can be calculated by the controller 34 housed in the downhole assembly 35. In this example, the VALUEs for each interval are 1, 0, 1. The master controller 34 uses the lookup table in its program to match an instruction to these VALUEs. In this case, the "command" interval VALUE=1, which corresponds to toolface correction, and the "data" interval VALUE=0, which corresponds to +5 degrees. Therefore, the master controller 34 will decode this information into an internal command to the 3-D rotary steerable drilling tool to correct the toolface +5 degrees.

The last interval for any instruction sequence is the parity. Parity is a number derived through mathematical computation to check the validity of the command and data VALUEs that the downhole assembly 35 received. Thus, the parity interval is used for error checking. Any of the standard error-checking methods known in the art is suitable for performing a parity calculation such as, for example, Cyclic Redundancy Coding (CRC).

To further describe parity, it is useful to define surface parity and downhole parity. If we know the VALUEs associated with the command and data intervals, those VALUEs can be used to calculate the surface parity, so called because it is determined at the surface before the instruction is sent downhole. Surface parity is communicated downhole via pulses just like the command and data. At the downhole receiver 21, another parity calculation is performed using the actual received pulses for the command and data. This is the downhole parity. The surface and downhole parities are then compared to one another. If they match, the downhole receiver 21 properly interpreted the pulse sequence for the command and data. If not, the downhole assembly 35 will send an uplink signal to indicate an error, and the instruction sequence can be repeated.

As an example, assume the VALUEs:

| Command (interval 1) | Data (interval 2) | Surface Parity (interval 3) |
|---|---|---|
| VALUE = 1 | VALUE = 0 | VALUE = 1 |

Assume also that the downhole receiver 21 interprets the time periods for each interval such that the VALUEs calculated by the controller 34 are:

| Command (interval 1) | Data (interval 2) | Surface Parity (interval 3) |
|---|---|---|
| VALUE = 0 | VALUE = 0 | VALUE = 1 |

The downhole parity will be computed using 0 for the command VALUE and 0 for the data VALUE, so the downhole parity will not match the surface parity. In response, the downhole assembly 35 will send an uplink signal indicating an error, and the pulse sequence will be generated again until properly received by the downhole receiver 21.

To summarize, for a 3-interval instruction, the first interval represents the command that identifies which component of the downhole assembly 35 is being instructed and what action to take. The second interval represents the data, which tells the responding component the magnitude of change to be made, and the third interval represents the surface parity, which provides a check to verify the instruction that was communicated downhole.

Potential Applications

Once the signals are interpreted, the master controller 34 disposed in the downhole assembly 35 matches VALUEs derived from the signals to a lookup table instruction, then distributes the instruction to the appropriate tool to perform the function. The lookup table can contain, but is not limited to, data that can be modified to make changes to software configurations, sensor parameters, data storage and transmission. One advantage of using the downlink telemetry system in combination with a master controller 34 is that the operator can control a number of different tools at the same time. For example, the drilling tool and formation evaluation tools may be connected in one downhole assembly 35, and the master controller 34 may give instructions to each of those tools depending upon the downlink signals it receives.

The downlink telemetry system is therefore a universal system capable of communicating with any type of downhole tool and capable of sending signals to each of the downhole tools. Further, because the present invention can accomplish fast downlink signaling and detection, communication may be continuous so that a signal may be sent to one tool followed by a signal to the next tool.

The present downlink telemetry system is capable of controlling 2D and 3D steerable rotary tools, remotely controllable adjustable stabilizers, remotely controllable downhole adjustable bend motors, and formation evaluation sensors that measure properties of the formation such as porosity, resistivity, gamma radiation, density, acoustic measurements, and magnetic resonance imaging. One benefit of this system is that commands may also be sent to turn off a particular tool for some period and then turn that tool back on as necessary.

The downhole assembly 35 is configurable for each run, allowing for the lookup table in the master controller 34 to be modified depending on the types of instructions that will be downlinked for a particular drilling run. Once the assembly 35 is operating downhole, it is possible to downlink instructions to modify the parameters in a particular lookup table. Another option is to download several sets of pre-programmed lookup tables into the master controller 34, and to alternate between tables as necessary through downlink signaling.

The ability to modify parameters or alternate between different lookup tables allows the master controller 34 to accommodate changes in the downlink data rate. Although the rate of downlink signaling is controlled at the surface, the downhole lookup table parameters must be synchronized with the parameters of the lookup tables in the surface control system. Thus, an increase or decrease in the data rate of downlink signaling can be accommodated by: 1) modifying the lookup table parameters for data transmission rate, or 2) switching between lookup tables containing different parameters for data transmission rate.

Switching between lookup tables also provides an effective high data rate of downlink signaling. Rather than downlinking a series of instructions for altering many parameters in a lookup table, multiple changes in operating modes can be accomplished by a single downlink instruction to switch to another lookup table.

Another advantage to the downlink telemetry system is the possibility of controlling drilling from a remote command center. Instead of having a person in charge of directional drilling and a person in charge of formation testing at each rig, these operators may be located at a remote command center with each person controlling a number of wells at the same time. These operators can then intervene to correct, for example, a drill bit going off course when the operator receives uplink data confirming the drill bit orientation. A downlink signal can then be sent remotely to correct that drill bit orientation if necessary. Further, some drilling tools are now equipped with auto pilot systems that allow a drill plan or map of the ideal borehole to be programmed into the drilling assembly 35 or automated surface control system. Using an autopilot system, a signal may be sent by the operator or automated surface control system at the surface computer 26 or remotely from a control center to downlink instructions to correct deviations from the plan. Another option is to pre-program several operating modes into the controller 34 such that signals may be sent downhole to instruct the controller 34 as to which computer program to utilize. Still another option is to send signals that directly program the controller 34 downhole.

Therefore, from a broad perspective, the downlink telemetry system disclosed herein can be used to control many types of downhole tools such as a drilling tool, formation evaluation tools, and other downhole tools. This system of communication can send instructions, turn equipment on and off as necessary, and change the pre-programmed operating modes for various tools.

While preferred embodiments of this invention have been shown and described, modifications thereof can be made by one skilled in the art without departing from the spirit or teaching of this invention. The embodiments described herein are exemplary only and are not limiting. Many variations and modifications of the downlink telemetry system apparatus and method are possible and are within the scope of the invention. Accordingly, the scope of protection is not limited to the embodiments described herein, but is only limited by the claims which follow, the scope of which shall include all equivalents of the subject matter of the claims.

What is claimed is:

1. A system for generating a signal for communicating with a downhole assembly comprising:

a transmitter for generating said signal in a flow of fluid being directed downhole through a drill string;

a control system for operating said transmitter without stopping said pumping; and a downhole receiver for receiving said signal and decoding said signal;

wherein said downhole receiver is a pressure while drilling tool that measures pressure within the drill string only.

2. A system for generating a signal for communicating with a downhole assembly comprising: a transmitter for generating said signal in a flow of fluid being directed downhole;

a control system fir operating said transmitter without stopping said pumping; and a downhole receiver for receiving said signal and decoding said signal;

wherein said transmitter comprises;

a flow control device being moveable between an open position and a closed position; said open position allowing a quantity of said fluid to flow through a bypass line;

a flow restrictor that sets said quantity;

a flow diverter; and a backpressure device.

3. The system of claim 2 wherein said downhole receiver comprises a flow meter or a pressure sensor.

4. The system of claim 2 wherein said decoded signal is an instruction to the downhole assembly.

5. The system of claim 2 further comprising a downhole master controller for distributing said decoded signal to a component of said downhole assembly.

6. The system of claim 2 wherein said flow restrictor is changeable to adjust said quantity.

7. The system of claim 2 wherein said flow restrictor is disposed in a manifold including a means for changing said flow restrictor to adjust said quantity.

8. The system of claim 2 wherein said flow restrictor is a bit jet nozzle having an orifice therethrough.

9. The system of claim 2 wherein said flow restrictor is formed of tungsten carbide.

10. The system of claim 2 wherein said control system moves said flow control device between said open position and said closed position to generate said signal.

11. The system of claim 2 wherein said flow control device further includes an actuator.

12. The system of claim 2 wherein said flow diverter is disposed between said flow restrictor and said flow control device.

13. The system of claim 2 wherein said flow diverter is shaped to streamline the flow.

14. The system of claim 2 wherein said flow diverter is constructed of materials that minimize wear.

15. The system of claim 2 wherein said backpressure device is located downstream of said flow control device.

16. The system of claim 2 wherein said backpressure device is a bit jet nozzle having an orifice therethrough.

17. The system of claim 2 wherein said transmitter and said control system are intrinsically safe.

18. The system of claim 2 wherein said flow restrictor is disposed upstream of said flow control device.

19. The system of claim 18 wherein said flow restrictor reflects pressure pulses generated by the flow control device.

20. The system of claim 2 wherein said downhole receiver further comprises:

a scheme for filtering said signal; and an algorithm for decoding said signal.

21. The system of claim 20 wherein said algorithm interprets one bit of information in a minimum of approximately two seconds.

22. The system of claim 20 wherein said algorithm further performs an error-checking function.

23. A system for generating a signal for communicating with a downhole assembly comprising:

a transmitter for generating said signal in a flow of fluid being directed downhole;

a control system for operating said transmitter without stopping said pumping; and a downhole receiver for receiving said signal and decoding said signal;

wherein said transmitter comprises:

a first flow control device having an open position and a closed position; said open position allowing a quantity of said fluid to flow through a first bypass line;

a first flow restrictor that sets said quantity;

a second flow control device having an on and an off position; said on position allowing a percentage of said fluid to flow through a second bypass line when said first flow control device is in the open position; and a second flow restrictor that sets said percentage.

24. The system of claim 23 wherein said quantity and said percentage may flow through said first and second bypass lines simultaneously.

25. The system of claim 23 wherein said control system operates said first flow control device between said open position and said closed position to generate said signal.

26. The system of claim 23 wherein said first flow control device is a pneumatically operated valve.

27. The system of claim 23 wherein said second flow control device is a valve.

28. The system of claim 23 wherein said second flow control device is operated between the on position and the off position only when the first flow control device is in the closed position.

29. The system of claim 23 wherein said second flow control device further includes a pneumatically controlled actuator and control system that operates the second flow control device between said on position and said off position.

30. A system for generating a signal for communicating with a downhole assembly comprising:

a transmitter for generating said signal in a flow of fluid being directed downhole;

a control system for operating said transmitter without stopping said pumping; and a downhole receiver for receiving said signal and decoding said signal;

wherein said control system comprises:

a computer for inputting an instruction; and a downlink controller for receiving said instruction from said computer and operating said transmitter to generate said signal.

31. The system of claim 30 wherein said computer includes a graphical user interface screen.

32. The system of claim 30 wherein said control system further comprises:

a pneumatic assembly for operating a pneumatic actuator on said transmitter for generating said signal.

33. The system of claim 33 wherein said pneumatic assembly comprises:

a pair of air valves;

a manual override manifold; and air lines including quick connect fittings.

34. A system for generating a signal in a flow of fluid being directed downhole for communicating with a downhole assembly comprising:

means for bypassing a quantity of fluid to generate said signal without stopping the pumping of said fluid;

means for restricting the quantity of fluid being bypassed; and means for receiving said signal and decoding said signal into said instruction.

35. A system for communicating with a downhole assembly comprising:

a transmitter for generating a signal in a flow of fluid being directed downhole; said transmitter comprising a flow control device and a flow restrictor;

a control system for operating said transmitter without stopping the fluid being pumped downhole; said control system comprising a computer and a downlink controller; and a downhole receiver for receiving said signal and decoding said signal; said downhole receiver comprising a pressure sensor.

36. A system for sending simultaneous, bi-directional signals between a surface assembly and a downhole assembly comprising:

a pump for continuously pumping a fluid between a surface location and a downhole location;

a bypass line for generating a downlink signal within a first frequency band without stopping said pump; and a pulser for generating an uplink signal within a second frequency band;

wherein said downlink signal and said uplink signal are generated simultaneously.

37. The system of claim 36 wherein said downlink signal is generated by diverting a portion of said fluid through said bypass line.

38. The system of claim 36 wherein said first frequency band is between five and ten times lower than said second frequency band.

39. A system for receiving and decoding a pressure pulse signal into an instruction to a downhole assembly comprising:

a receiver for receiving said signal; and an algorithm for decoding said signal; said decoding comprising:

filtering said signal to generate a filtered signal;

cross-correlating said filtered signal using a template waveform to generate a processed signal;

determining said instruction from said processed signal; and performing an error check to ensure said instruction was properly determined.

40. A system for receiving and decoding a pressure pulse signal into an instruction to a downhole assembly comprising:

a receiver for receiving said signal; and an algorithm for decoding said signal downhole; said decoding comprising;

filtering said signal to generate a processed signal; and determining said instruction from said processed signal.

41. A method for communicating with a subsurface assembly comprising:

introducing a series of pressure pulses into a fluid being pumped into a well without interrupting the pumping;

receiving downhole a signal that includes the series; and decoding the signal.

wherein each pulse has a duration above the shock wave regime.

42. The method of claim 41 wherein the series of pressure pulses forms an instruction.

43. The method of claim 41 wherein the series of pressure pulses is introduced by bypassing a portion of the fluid being pumped into the well.

44. The method of claim 41 wherein each pulse is one or more seconds in duration.

45. The method of claim 41 wherein the series of pressure pulses is introduced by opening and closing a flow control device.

46. The method of claim 45 wherein opening the flow control device allows a portion of the fluid to flow through a bypass line.

47. The method of claim 46 wherein said portion is adjusted by a flow restrictor.

48. The method of claim 45 wherein opening the flow control device allows a portion of the fluid to flow through a first bypass line and a quantity of the fluid to flow through a second bypass line.

49. The method of claim 48 wherein a valve allows or prevents the quantity from flowing through the second bypass line.

50. The method of claim 41 wherein decoding the signal comprises:

passing the signal through at least one filter to create a processed signal; and passing the processed signal through an algorithm.

51. The method of claim 50 wherein creating the processed signal comprises creating a filtered signal and cross-correlating the filtered signal with a template waveform.

52. The method of claim 51 wherein creating the filtered signal comprises passing the signal through a median filter and a band pass filter.

53. The method of claim 51 wherein the template waveform is a bipolar square wave.

54. The method of claim 50 wherein passing the signal through the at least one filter removes noise and the DC component of the signal.

55. The method of claim 50 wherein said processed signal comprises samples including a series of peaks with an interval of time provided between each peak.

56. The method of claim 55 wherein each interval comprises a number of bits of information.

57. The method of claim 55 wherein the intervals form an instruction comprising at least one command interval, at least one data interval, and a parity interval.

58. The method of claim 57 wherein the parity interval is for verifying that the instruction was properly received.

59. The method of claim 55 wherein passing the processed signal through an algorithm comprises:

determining each interval in the processed signal;

calculating a value for each interval; and matching the value for each interval to a table entry.

60. The method of claim 59 further including error checking the calculated values.

61. The method of claim 59 wherein determining each interval comprises:

comparing each sample in the processed signal to a threshold;

determining each peak in the processed signal from the samples that exceed the threshold;

determining a time for each peak; and calculating the interval between the peak times.

62. A method of achieving simultaneous, bi-directional communication between a surface system and a downhole assembly comprising:

transmitting to the downhole assembly a downlink series of pulses within a first frequency band;

transmitting to the surface system an uplink series of pulses within a second frequency band;

receiving a first signal at the downhole assembly; and receiving a second signal at the surface system.

63. The method of claim 62 further including:

filtering the uplink series out of the first signal; and filtering the downlink series out of the second signal.

64. The method of claim 62 wherein the second frequency band is between five and ten.

65. A method for drilling a borehole comprising:

transmitting to a drilling assembly a series of downlink instruction signals; and optionally transmitting from the drilling assembly a series of uplink data signals;

wherein said downlink instruction signals and said uplink data signals may be transmitted simultaneously.

66. A method for drilling an accurately located well borehole at a drilling site that is optimized for minimum drag and maximum drilling efficiency comprising:

transmitting to a drilling assembly a series of downlink instruction signals; and selectively transmitting from the drilling assembly a series of uplink data signals;

wherein said downlink instruction signals and said uplink data signals may be transmitted simultaneously.

67. The method of claim 66 wherein the drilling assembly comprises rotary steerable/directional drilling tools.

68. The method of claim 67 wherein the drilling tools comprise one or more of a rotary steerable tool, a remotely controllable adjustable stabilizer, and a remotely controllable downhole adjustable bend motor.

69. The method of claim 66 further comprising:

monitoring the borehole conditions during drilling; and adjusting the drilling assembly.

70. The method of claim 69 wherein the monitoring and the adjusting are done continuously.

71. A method for transmitting a computer command to a surface transmitter that generate downlink instruction signals to control a directional drilling operation at a drilling site wherein the computer command is transmitted from a location remote from the drilling site.

72. The method of claim 71 wherein the location remote from the drilling site is a command center capable of remotely controlling a plurality of directional drilling operations at a plurality of different drilling sites.

73. A method for automatically drilling a well borehole at a drilling site using bi-directional downlink and uplink signaling wherein the computer commands are transmitted either locally from the drilling site or from a location remote from the drilling site to a surface transmitter that generates downlink signaling.

74. The method of claim 73 wherein a drilling assembly and a surface controller are programmed with a predetermined trajectory for the well borehole and the well borehole is automatically drilled by the drilling assembly.

75. The method of claim 74 wherein the bi-directional signaling is used to maintain the drilling assembly on the predetermined trajectory.

76. A method for sending downlink instruction signals without interrupting drilling and without interruption the ability to simultaneously send uplink signals, to effect an operating change to any of a plurality of downhole tools in a downhole assembly.

77. The method of claim 76 wherein the operating change is turning a tool on or off to reduce the total power consumed by the downhole assembly.

78. The method of claim 76 wherein the operating change is to change between preprogrammed lookup tables.

79. The method of claim 76 wherein the operating change is to alter parameters of a preprogrammed lookup table.

80. A method for sending downlink instruction signals without interrupting fluid circulation and without interrupting the ability to simultaneously send uplink signals, to effect an operating change to any of a plurality of downhole tools in a downhole assembly; wherein the operating change is to take a sample using a drilling formation tester.

81. A method for increasing or decreasing the data rate of downlink signaling to communicate an instruction to a downhole assembly utilizing a plurality of preprogrammed lookup tables.

82. The method of claim 81 wherein increasing or decreasing the data rate of downlink signaling comprises switching between preprogrammed lookup tables.

83. The method of claim 81 wherein increasing or decreasing the data rate of downlink signaling comprises communicating an instruction to modify parameters in the preprogrammed lookup tables.

84. The method of claim 81 further comprising increasing or decreasing the data rate of uplink signaling wherein the data rate of downlink signaling can be increased or decreased if the data rate of uplink signaling is increased or decreased.

85. A method for achieving an effective high data rate of downlink signaling to communicate an instruction to a downhole assembly utilizing a plurality of preprogrammed lookup tables.

86. The method of claim 85 wherein the effective high data rate of downlink signaling is achieved by switching between preprogrammed lookup tables.

87. The method of claim 85 wherein the effective high data rate of downlink signaling is achieved by communicating an instruction to modify parameters in the preprogrammed lookup tables.

88. A method of achieving high data rate downlink and uplink signaling wherein the data rate of downlink signaling can be increased when the data rate of uplink signaling is increased.

* * * * *

UNITED STATES PATENT AND TRADEMARK OFFICE

CERTIFICATE OF CORRECTION

PATENT NO. : 6,920,085 B2 
APPLICATION NO. : 09/783158
DATED : July 19, 2005
INVENTOR(S) : Michael Dewayne Finke et al.

It is certified that error appears in the above-identified patent and that said Letters Patent is hereby corrected as shown below:

On the title of the patent under item (56), References Cited, U.S. Patent Documents add: --6,513,606 B1 * 2/2003, Krueger, 175/61--

Column 23, claim 2, line 5, replace “fir” with --for--.

Column 28, claim 76, line 5, replace “interruption” with --interrupting--.

Signed and Sealed this

Thirty-first Day of October, 2006

JON W. DUDAS
*Director of the United States Patent and Trademark Office*